US005715164A

United States Patent [19]

Liechti et al.

[11] Patent Number: 5,715,164

[45] Date of Patent: Feb. 3, 1998

[54] SYSTEM AND METHOD FOR COMMUNICATIONS WITH POSTAGE METERS

[75] Inventors: Hans-Peter Liechti, deceased, late of Berne, Switzerland, by Rose-Marie Liechti-Moser, legal representative; Philipp Merz, Basel; Louis Baldisserotto, Berne, both of Switzerland

[73] Assignee: Ascom Hasler Mailing Systems AG, Berne, Switzerland

[21] Appl. No.: 355,638

[22] Filed: Dec. 14, 1994

[51] Int. Cl.[6] ..... G07B 17/00

[52] U.S. Cl. ..... 364/464.2; 235/375; 235/381; 364/464.14

[58] Field of Search ..... 364/464.02, 464.03, 364/464.11, 464.14, 464.18, 464.2; 235/375, 380, 381

[56] References Cited

U.S. PATENT DOCUMENTS

| | | | |
|---|---|---|---|
| 4,097,923 | 6/1978 | Eckert, Jr. et al. | 364/900 |
| 4,222,518 | 9/1980 | Simjian | 235/375 |
| 4,226,360 | 10/1980 | Simjian | 235/375 |
| 4,249,071 | 2/1981 | Simjian | 235/375 |
| 4,280,180 | 7/1981 | Eckert et al. | 364/900 X |
| 4,420,819 | 12/1983 | Price et al. | 364/900 |
| 4,447,890 | 5/1984 | Duwel et al. | 364/900 |
| 4,516,209 | 5/1985 | Scribner | 364/466 |
| 4,528,644 | 7/1985 | Soderberg et al. | 364/900 |
| 4,636,975 | 1/1987 | Soderberg et al. | 364/900 |
| 4,731,728 | 3/1988 | Muller | 364/466 |
| 4,731,749 | 3/1988 | Kirschner et al. | 364/900 |
| 4,739,486 | 4/1988 | Soderberg et al. | 364/466 X |
| 4,752,950 | 6/1988 | Le Carpentier | 379/106 |
| 4,757,532 | 7/1988 | Gilham | 380/23 |
| 4,780,601 | 10/1988 | Vermesse | 235/375 |
| 4,807,139 | 2/1989 | Liechti | 364/464.02 |
| 4,812,994 | 3/1989 | Taylor et al. | 364/464.02 |
| 4,837,701 | 6/1989 | Sansone et al. | 364/464.03 |
| 4,868,757 | 9/1989 | Gil | 364/464.03 |
| 4,893,000 | 1/1990 | Jackson | 235/380 |
| 4,900,905 | 2/1990 | Pusic | 235/381 |
| 4,907,271 | 3/1990 | Gilham | 380/25 |
| 4,914,654 | 4/1990 | Matsuda et al. | 370/94.1 |
| 4,928,244 | 5/1990 | Vermesse | 364/464.02 |
| 4,934,846 | 6/1990 | Gilham | 400/104 |
| 4,962,454 | 10/1990 | Sansone et al. | 364/464.02 |
| 4,978,839 | 12/1990 | Chen et al. | 235/375 |
| 5,025,383 | 6/1991 | Haines et al. | 364/464.03 |
| 5,025,386 | 6/1991 | Pusic | 364/478 |
| 5,058,025 | 10/1991 | Haines et al. | 364/464.02 |
| 5,077,660 | 12/1991 | Haines et al. | 364/464.02 |
| 5,077,792 | 12/1991 | Herring | 380/24 |
| 5,107,455 | 4/1992 | Haines et al. | 395/275 |
| 5,111,030 | 5/1992 | Brasington et al. | 235/380 |
| 5,173,862 | 12/1992 | Fedirchuk et al. | 364/464.02 |
| 5,181,245 | 1/1993 | Jones | 380/23 |
| 5,202,834 | 4/1993 | Gilham | 364/464.02 |
| 5,206,812 | 4/1993 | Abumehdi | 364/464.02 |
| 5,233,657 | 8/1993 | Günther | 380/23 |
| 5,237,506 | 8/1993 | Horbal et al. | 364/464.02 |

(List continued on next page.)

OTHER PUBLICATIONS

M. Smid et al., "The Data Encryption Standard: Past and Future," *Proceedings of the IEEE*, vol. 76, No. 5, pp. 550–559, May 1988.

*Primary Examiner*—Edward R. Cosimano

*Attorney, Agent, or Firm*—Brumbaugh, Graves, Donohue & Raymond

[57] ABSTRACT

In a communications system, a host computer in a data center communicates with a multiplicity of electronic postage meters via telephone dial-up lines to conduct telemeter setting (TMS) transactions. Through the communications, the host computer may collect statistical data from each meter, and may impose a cumulative postage amount limit, a time limit and/or a piece limit on the meter. To ensure security and data integrity, the communicated data between the meters and the host computer is selectively encrypted and/or authenticated.

88 Claims, 14 Drawing Sheets

U.S. PATENT DOCUMENTS

| | | | |
|---|---|---|---|
| 5,243,654 | 9/1993 | Hunter | 380/51 |
| 5,257,196 | 10/1993 | Sansone | 364/464.02 |
| 5,309,363 | 5/1994 | Graves et al. | 364/464.02 |
| 5,319,562 | 6/1994 | Whitehouse | 364/464.03 |
| 5,323,323 | 6/1994 | Gilham | 364/464.02 |
| 5,337,246 | 8/1994 | Carroll et al. | 364/464.02 |
| 5,340,965 | 8/1994 | Horbal et al. | 235/101 |
| 5,341,505 | 8/1994 | Whitehouse | 395/800 |

| | remote meter resetting (bit 15) | remote counter reading (bit 14) | remote configuration (bit 13) | remote statistics (bit 12) | reserved (bit 11) | reserved (bit 10) | reserved (bit 9) | reserved (bit 8) | control as hex number (bits 8–15) | subcontrol as hex number (bits 0–7) | R = control request; C = control command | explanation |
|---|---|---|---|---|---|---|---|---|---|---|---|---|
| | 0 | 0 | 0 | 0 | 0 | 0 | 0 | 0 | 00 | 00 | R,C | reserved |
| | 1 | 0 | 0 | 0 | 0 | 0 | 0 | 0 | 80 | 01 | R,C | Standard remote meter resetting |
| | 0 | 1 | 0 | 0 | 0 | 0 | 0 | 0 | 40 | 01 | R,C | Standard remote counter reading |
| 681 | 1 | 0 | 0 | 1 | 0 | 0 | 0 | 0 | 90 | 01 | R | Meter resetting & statistics request response possibilities: |
| 683 | 1 | 0 | 0 | 1 | 0 | 0 | 0 | 0 | 90 | 01 | C | Meter resetting & statistics command; keep same statistics class definitions as before |
| 685 | 1 | 0 | 1 | 1 | 0 | 0 | 0 | 0 | 80 | 01 | C | Meter resetting & configuration & statistics command; set new statistics class definitions |
| | 0 | 1 | 0 | 1 | 0 | 0 | 0 | 0 | 50 | 01 | R | Counter reading & statistics request response possibilities: |
| | 0 | 1 | 0 | 1 | 0 | 0 | 0 | 0 | 50 | 01 | C | Counter reading & statistics command; keep same statistics class definitions as before |
| | 0 | 1 | 1 | 1 | 0 | 0 | 0 | 0 | 70 | 01 | C | Counter reading & configuration & statistics command; set new statistics class definitions |
| 687 | 1 | 0 | 0 | 0 | 0 | 0 | 0 | 0 | 80 | 02 | R,C | Refund for available postage amount |
| 689 | 1 | 0 | 0 | 0 | 0 | 0 | 0 | 0 | 80 | 03 | R,C | Refund for available postage amount and disable meter |
| 691 | 0 | 1 | 0 | 0 | 0 | 0 | 0 | 0 | 40 | 03 | R,C | Remote counter reading and disable meter |

FIG. 6B

| | | | | | | | | |
|---|---|---|---|---|---|---|---|---|
| 01 | 01 | 01 | 01 | 01 | 01 | 01 | 01 | hex |
| FE | FE | FE | FE | FE | FE | FE | FE | hex |
| 1F | 1F | 1F | 1F | 1F | 1F | 1F | 1F | hex |
| E0 | E0 | E0 | E0 | E0 | E0 | E0 | E0 | hex |

WEAK DES KEYS

FIG. 7A

| | | | | | | | | |
|---|---|---|---|---|---|---|---|---|
| 01 | FE | 01 | FE | 01 | FE | 01 | FE | hex |
| FE | 01 | FE | 01 | FE | 01 | FE | 01 | hex |
| 1F | E0 | 1F | E0 | 0E | F1 | 0E | F1 | hex |
| E0 | 1F | E0 | 1F | F1 | 0E | F1 | 0E | hex |
| 01 | E0 | 01 | E0 | 01 | F1 | 01 | F1 | hex |
| E0 | 01 | E0 | 01 | F1 | 01 | F1 | 01 | hex |
| 1F | FE | 1F | FE | 0E | FE | 0E | FE | hex |
| FE | 1F | FE | 1F | FE | 0E | FE | 0E | hex |
| 01 | 1F | 01 | 1F | 01 | 0E | 01 | 0E | hex |
| 1F | 01 | 1F | 01 | 0E | 01 | 0E | 01 | hex |
| E0 | FE | E0 | FE | F1 | FE | F1 | FE | hex |
| FE | E0 | FE | E0 | FE | F1 | FE | F1 | hex |

SEMI-WEAK DES KEYS

FIG. 7B

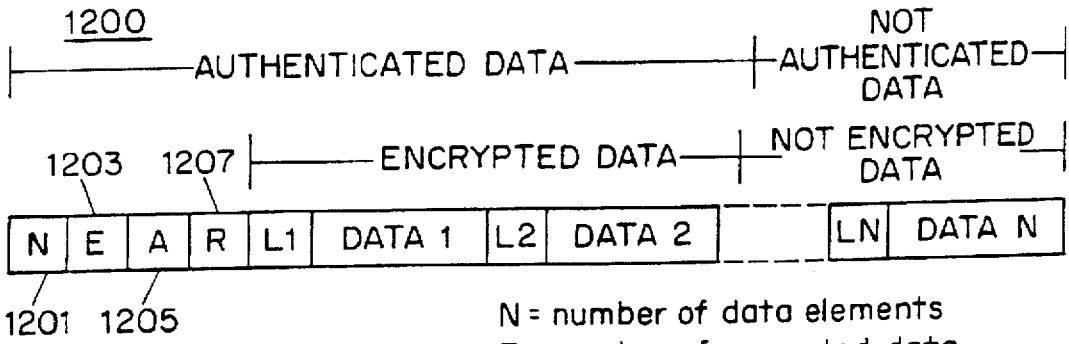

N = number of data elements
E = number of encrypted data elements
A = number of authenticated data elements
R = reserved
Lx = size of data element x (bytes)
N, E, A, R, Lx: – must not be encrypted
– are not authenticated if A = 0

$$\text{Total size} = 8 + N + \sum_{x=1}^{x=N} Lx$$

with: size of Lx is always 1 byte sizes of N, E, A, R are always 2 bytes

FIG. 12

| N=4 E=0 A=0 R=0 | | | |
|---|---|---|---|
| DATA ELEMENT NO. | Lx | BYTE NO. | DATA X CONTENT |
| 1 | $L_1=3$ | 1 and 2<br>3 | CLASS 0<br>STATISTICAL HITS = 175 |
| 2 | $L_2=4$ | 1 and 2<br>3 and 4 | CLASS 3<br>STATISTICAL HITS = 9, 278 |
| 3 | $L_3=5$ | 1 and 2<br>3 thru 5 | CLASS 4<br>STATISTICAL HITS = 71, 289 |
| 4 | $L_4=3$ | 1 and 2<br>3 | CLASS 7<br>STATISTICAL HITS = 246 |

FIG. 13

| N=S E=O A=S R=O | | | |
|---|---|---|---|
| DATA ELEMENT NO. | Lx | BYTES | DATA X CONTENT |
| 1 | $L_1=6$ | 6 | NEW READING DATE |
| 2 | $L_2$ | 1 | FIRST CLASS MAIL |
| | | $(L_2-1)/2$ | CLASS 1 Lower limit (inclusive) |
| | | $(L_2-1)/2$ | CLASS 1 Upper limit (inclusive) |
| 3 | $L_3$ | 1 | EXPRESS MAIL |
| | | $(L_3-1)/2$ | CLASS 2 Lower limit (inclusive) |
| | | $(L_3-1)/2$ | CLASS 2 Upper limit (inclusive) |
| ⋮ | ⋮ | ⋮ | ⋮ |
| S | $L_S$ | 1 | PARCEL POST |
| | | $(L_S-1)/2$ | CLASS S Lower limit (inclusive) |
| | | $(L_S-1)/2$ | CLASS S Upper limit (inclusive) |

SYSTEM AND METHOD FOR COMMUNICATIONS WITH POSTAGE METERS

TECHNICAL FIELD

This invention relates to a communications system and method, and more particularly to communications between electronic postage meters and a computerized central facility in such a system and method.

BACKGROUND OF THE INVENTION

Tele-meter setting (TMS) techniques are known for enabling a postage meter user to have the meter reset with additional postage by telephone. For example, some of these techniques are disclosed in U.S. Pat. No. 5,237,506 issued Aug. 17, 1993 to Horbal et al., and U.S. Pat. No. 4,097,923 issued Jun. 27, 1978 to Eckert, Jr. et al. With such a technique, the need to carry the meter to a postal authority for authorized resetting is obviated. In a typical telephone resetting process, the user, or, by modem, the user's meter calls a computerized central facility for additional available postage. The central facility then verifies the meter's identity and ascertains the availability of funds in the user's account. After the information is validated, the central facility debits the user's account and supplies a combination code to the meter or to the user for the user to introduce into the meter. The meter then independently generates another combination code and compares it with the received code. If their relationship is correct, for example, if the combination codes are the same, the meter is reset with the additional postage requested.

Also well-known is a data encryption standard (DES) cryptographic algorithm for securing secrecy of data communications. The DES algorithm involves a number of iterations of a simple transformation of data to be encrypted, which applies alternately transposition and substitution techniques thereto. This algorithm requires a selected DES key to encrypt and decrypt the data. The key must be kept secret because the DES algorithm itself is publicly known and learning the DES key would allow one to decrypt the encrypted data.

The DES key consists of eight bytes. During encryption, the DES algorithm divides a data byte sequence into blocks of eight bytes. It operates on a block at a time, dividing the block in half and encrypting the characters one after another. The characters are scrambled 16 times, under control of the key, resulting in 64 bits of encrypted text or ciphertext.

The DES provides four distinct modes of operation that differ in complexity and use. For details of these four modes of operation, one can refer to the publication by M. Smid et al., "The Data Encryption Standard: Past and Future," *Proceedings of the IEEE*, Vol. 76, No. 5, May 1988. One of the four DES modes is known as the "Cipher Block Chaining (CBC)" mode as it chains together blocks of ciphertext. The CBC mode encrypts each block based on the eight data bytes in the block, the key, and a third value, which is a function of the preceding block. This repetitive encryption, called chaining, hides repeated patterns.

Certain cryptographic algorithms may also be used to authenticate data communications so as to prevent virus attack or data tampering. In fact, the application of the above DES CBC mode has been recently extended to data authentication. When one applies the CBC mode encryption to a data message in a manner described above, a message authentication code results and can be appended to the message as a signature. Without the knowledge of the DES key used, it is virtually impossible to forge the signature. When the message, along with the authentication code, is received, the recipient independently calculates an authentication code based on the received message and compares it with the received code. If the two codes are identical, it is extremely likely that the message was sent without alteration.

SUMMARY OF THE INVENTION

An object of the invention is to provide effective communications between postage meters and a computerized central facility not only for the TMS purposes, but also for other administrative purposes.

In accordance with the invention, the central facility communicates with each meter to define at least one charge class in the meter with an upper bound having a first postage value and a lower bound having a second postage value. The postage meter associates a subset of the mail items processed thereby with the charge class based on postage values selected for the subset. In this instance, the selected postage values fall between the upper bound and the lower bound of the charge class. Statistical data on the number of mail items in the subset is compiled using counters in the postage meters. The statistical data is read at pre-selected times and is subsequently transferred to the central facility. The latter maintains detailed statistical records for each meter.

In accordance with a feature of the invention, the above upper and lower bounds of a charge class may be changed at specified times. Memory buffers are provided in the meter to temporarily store the new upper and lower bound values communicated thereto until the specified times are reached. At such times, these new values are transferred from the buffers and become effective.

In accordance with another feature of the invention, the central facility may also communicate with each postage meter to restrict use of the meter, thereby facilitating security and maintenance of the meter. For example, the facility may impose on the meter limits on the meter's use time, the number of mail items which the meter can process, and the cumulative postage amount which the meter can dispense. The imposition of the postage amount limit is advantageous in a postpayment scheme, where the meter user is billed for meter reset amounts, as it controls the amount of credit extended to the meter user.

BRIEF DESCRIPTION OF THE DRAWING

Further objects, features and advantages of the invention will become apparent from the following detailed description taken in conjunction with the accompanying drawing showing a preferred embodiment of the invention, in which:

FIG. 6B is a table for looking up control requests by the meter and control commands by the data center during their communications;

FIGS. 7A and 7B are tables respectively enumerating weak DES keys and semi-weak DES keys for encryption and/or authentication of selected data for transmission;

FIG. 12 includes a block diagram illustrating a dynamic data structure used by selected fields of the packets in accordance with the invention;

FIG. 13 is a table describing the content of an exemplary further amount data field in the dynamic data structure of FIG. 12;

Throughout the figures of the drawing, the same reference numerals and characters are used to denote like features, elements, components or portions of the illustrated system.

DETAILED DESCRIPTION

Figure 1:
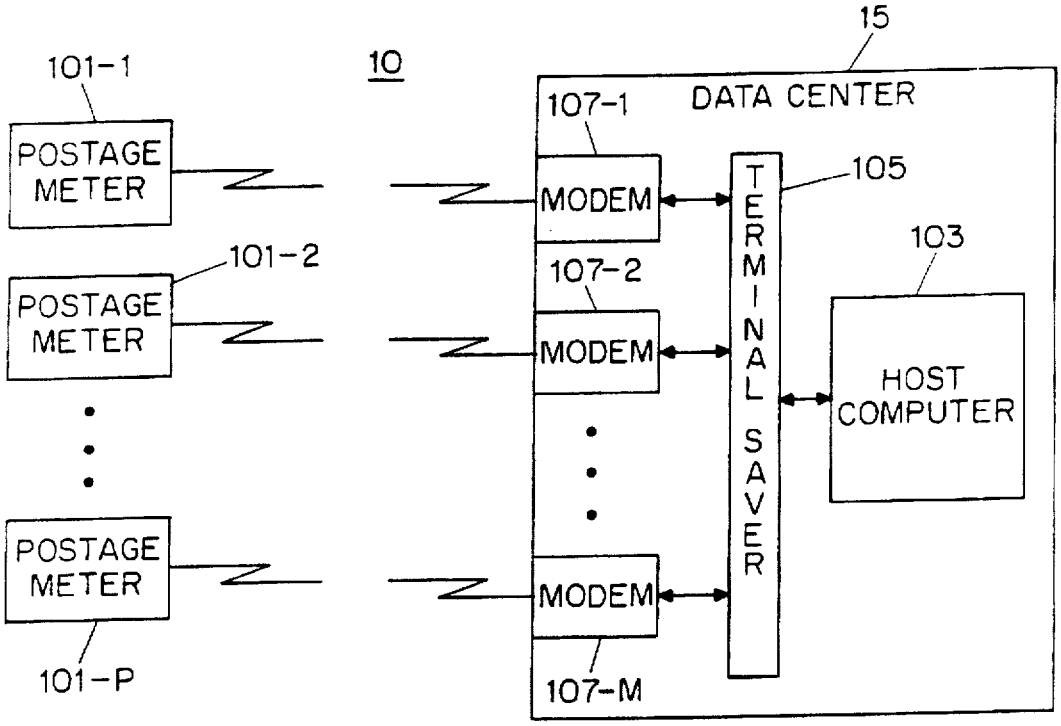
FIG. 1 is a block diagram of a system for communications between a data center and postage meters in accordance with the invention.

In FIG. 1, system 10 comprises data center 15 and a multiplicity of electronic postage meters 101-1 through 101-p which are structurally identical, where p is an integer. Host computer 103 in data center 15 is capable of communicating data with the meters via telephone dial-up lines for example. To this end, host computer 103 is connected to terminal server 105 of conventional design. Server 105 enables the host to simultaneously communicate with the postage meters through selected ones of modems 107-1 through 107-m, where m is a predetermined integer.

Figure 2:
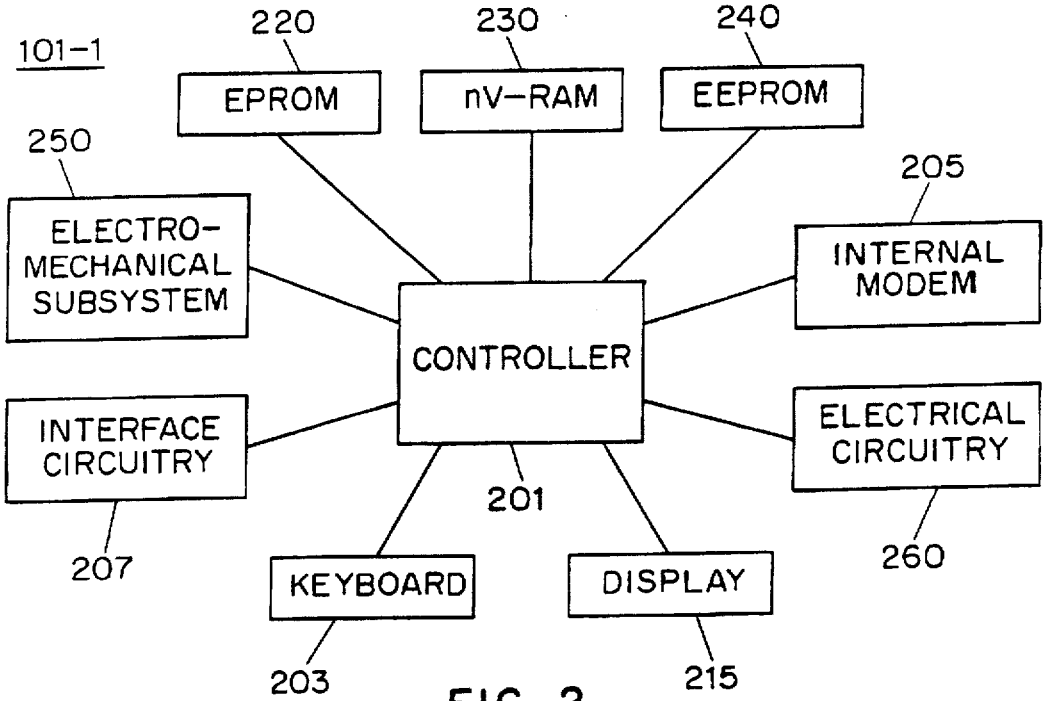
FIG. 2 is a block diagram of a postage meter of FIG. 1.

In FIG. 2, postage meter 101-1 is shown and is illustrative of meters 101-1 through 101-p of FIG. 1. Central to meter 101-1 is controller 201 comprising a conventional microprocessor (not shown). Controller 201 is programmed to orchestrate the operation of meter 101-1. Connected to controller 201 are keyboard 203, internal modem 205, interface circuitry 207, display 215, erasable programmable read-only-memory (EPROM) 220, non-volatile random-access-memory (nv-RAM) 230, electrically erasable programmable read-only memory (EEPROM) 240, electromechanical subsystem 250, and electrical circuitry 260. Keyboard 203 enables a user to enter data and/or commands into the meter. Internal modem 205 is used for establishing communications with data center 15 through one of modems 107-1 through 107-m. Interface circuitry 207 comprises universal-asynchronous-receiver-transmitters (UART's) configured as RS-422 and RS-232 input/output (I/O) ports. With these I/O ports, meter 101-1 can be interfaced with peripheral devices such as a postal scale, a personal computer (PC), etc. Display 215 is capable of displaying internal messages and messages from data center 15. EPROM 220 contains an operation program which provides instructions for controller 201 to operate meter 101-1. Electromechanical subsystem 250 comprises standard meter components such as drivers and sensors for effectuating the printing of desired postage on mail items, and interposer mechanism for controllably locking the meter from further operation and unlocking the meter to resume its operation. Electrical circuitry 260 comprises standard components such as a power-supply, real-time clock including a calendar mechanism for providing a signal that represents the current date, battery for providing power to the realtime clock, etc.

Figure 3A:
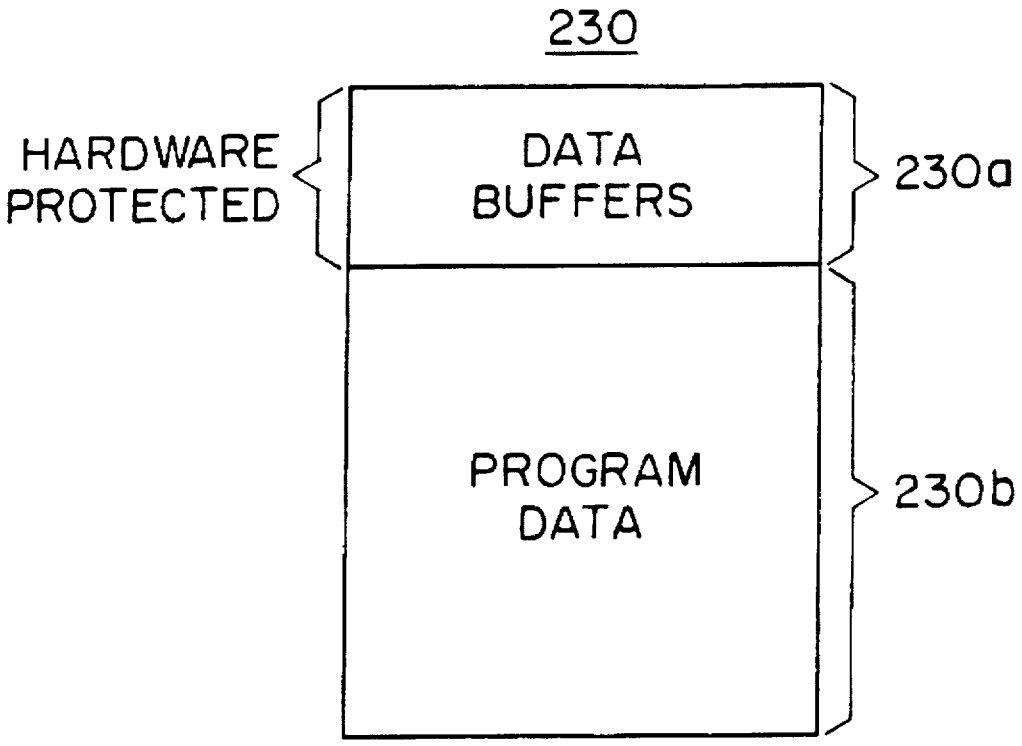
FIG. 3A illustrates a memory map of memory space provided in the meter of FIG. 2.

FIG. 3A illustrates a memory map of the memory space provided by nv-RAM 230 of meter 101-1. Memory module **230*a* within nv-RAM 230 is hardware protected and includes ringbuffers consisting of pages. Each page contains, for example, (a) time and date of page storage, (b) a piece counter keeping track of a total number of mail items processed, (c) a descending register, (d) an ascending register and (e) cyclic redundancy checks (CRC). The latter result from processing of transmitted data in accordance with a standard error detection scheme for detecting errors in the transmitted data occasioned by noisy telephone dial-up lines. Memory module 230*b*** includes work space, and buffers for temporarily storing program data including, for example, a class definitions buffer and limits buffer to be described.

Figure 3B:
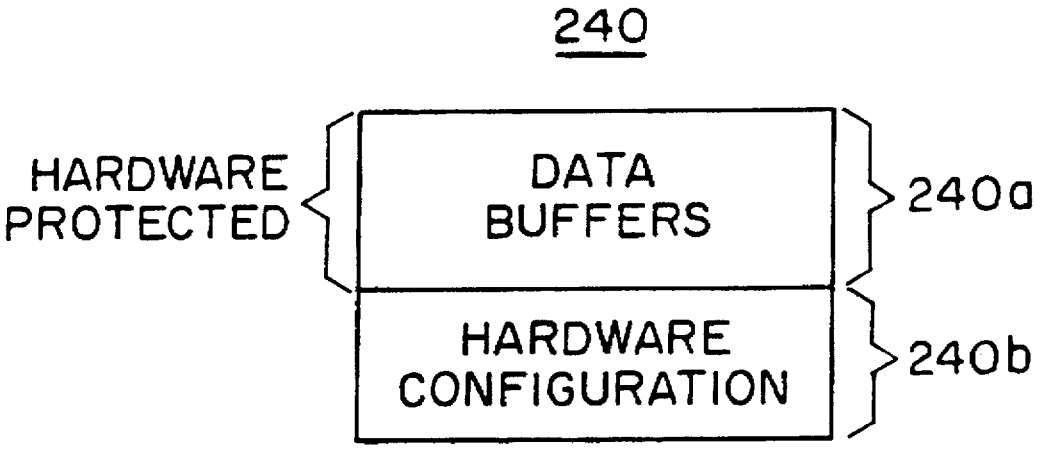
FIG. 3B illustrates another memory map of second memory space provided in the meter of FIG. 2.

FIG. 3B illustrates a memory map of the memory space provided by EEPROM 240. Memory module **240*a* within EEPROM 240 is also hardware protected and keeps a copy of the contents of module 230*a*. Memory module 240*b*** contains data on the hardware configuration of the meter.

In this illustrative embodiment, data center 15 is controlled by a postal authority for example. Among other things, the postal authority may be interested in gathering statistical data including, for example, numbers of mail items in different postal classes (e.g. first class mail, parcel post, international mail, etc.) processed by a postage meter. Such data is not available in a prior art postage meter.

In accordance with an aspect of the invention, each postage meter is programmed to have charge classes each defined by an upper limit and a lower limit of postage values. If a class should be defined by a single value, the lower and upper limits are set to that value. For example, charge class 1 includes items with a postage value of 29 cents; charge class 2 includes items with postage values between 30 cents and 35 cents; charge class 3 includes items with postage values between 36 cents and 42 cents, and so on and so forth; any items that do not fall within one of the above charge classes are grouped within a separate, miscellaneous class 0.

Each of the above charge classes is designed to relate to a postal class. Mail items processed by the meter are tallied according to these charge classes. To this end, the meter allocates a counter for each charge class to count the items belonging to the class. The count is cumulative until the counter is read into a class reading buffer to be subsequently transferred to the data center 15.

With the inventive communication protocol to be described, data center 15 from time to time collects from each meter the class statistical data, and may change the structure of the charge classes of the meter.

In accordance with another aspect of the invention, each meter is imposed with a postage amount limit, a time limit and a piece limit, and these limits are communicated by data center 15 to the meter. When any one of the limits is reached, the meter is programmed to halt its operation. A limit may be avoided by having data center 15 set the corresponding limit value to be unlimited.

In a conventional manner, the descending register in a meter is used to keep track of an amount of postage available for printing. On the other hand, the ascending register is used to keep track of an amount of postage printed. When the value of the descending register decreases over time below a predetermined limit, the meter operation is halted until the meter is reset. In accordance with a conventional TMS prepayment scheme, the reset amount, when approved, is added to the current value of the descending register, and the meter may then resume its operation.

In accordance with the invention, the value of the ascending register may not exceed the postage amount limit at any time. The meter becomes inoperative as soon as the ascending register value is greater than or equal to the postage amount limit. Only by connection of the meter to data center 15, may a new postage amount limit be established. The imposition of the postage amount limit is advantageous in a postpayment scheme, where the meter user is billed for the reset amounts, as it controls the amount of credit extended to the user. The postage amount limit is adjusted by data center 15 depending on the user's creditworthiness.

The time limit imposed on a meter restricts a time period within which the meter is operative. Specifically, the time limit is expressed as a pre-selected date after which the meter is no longer allowed to process any mail items. That is, immediately after the pre-selected date has passed, the meter is locked from further operation. Only by connection of the meter to data center 15, may a new time limit be established and the meter be unlocked and resume the operation. Again, the data center has full control over the amount of operation time granted to a particular meter depending on the trustworthiness of the meter user.

As an alternative, the above time-limit concept may be implemented using a downcounting timer in the meter. The time limit is expressed as an amount of meter operation time allowed in terms of hours, minutes and seconds for example. The downcounting timer counts down, to zero, a set time which may be the initially allowed time limit. The meter is locked as soon as the timer runs down to zero. Only by connection of the meter to data center 15, may a new time limit be added to the current run time of the timer to (a) restart its operation if the current run time is zero or (b) increase its operation time if the current run time is nonzero.

The piece limit imposed on a meter restricts the number of mail items processed by the meter. That is, during operation, the meter may not process more mail items than the allowed piece limit. The meter will be locked from further operation as soon as the piece counter reaches the piece limit. Only by connection of the meter to data center 15, may a new piece limit be established and the meter be unlocked and resume the operation. Once again, data center 15 has control over the limit value and thus the use of the meter.

Alternatively, the above piece-limit concept may be implemented using a downcounting piece counter in the meter. The latter counts down, to zero, a set number of mail items which may be the initially allowed piece limit. The meter is locked as soon as the zero count is detected. Only by connection of the meter to data center 15, may a new piece limit be added to the current count of the counter to (a) restart its operation if the current count is zero, or (b) increase the allowed count if the current count is nonzero.

Figure 4:
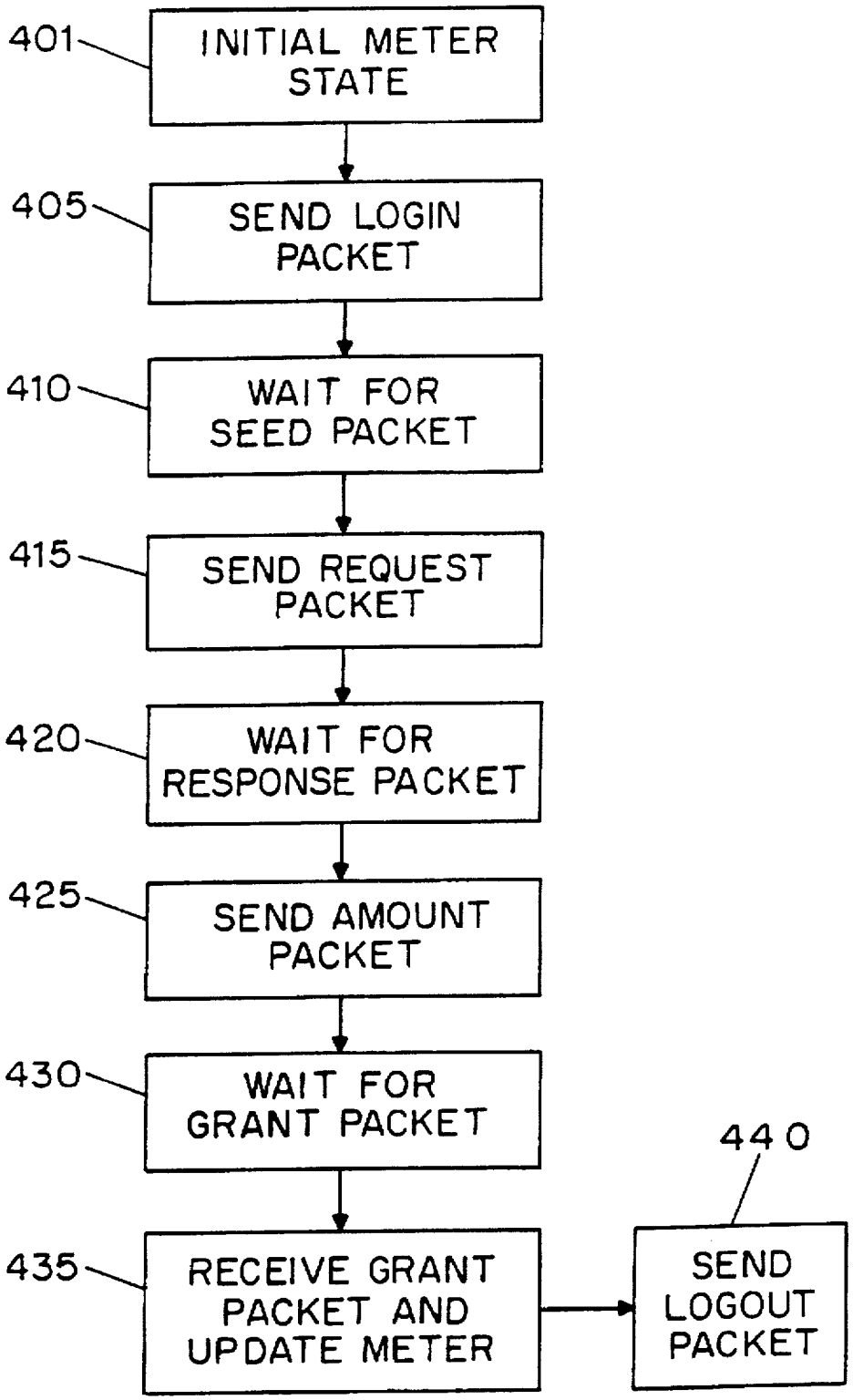
FIG. 4 is a flow chart illustrating a routine performed by the meter for conducting a TMS transaction with the data center in accordance with the invention.

FIG. 4 is a flow chart describing a routine on the meter for conducting a TMS transaction with data center 15 in accordance with the invention. Instructed by the routine in the operation program in EPROM 220, controller 201 starts with an initial meter state at step 401. Controller 201 at this state initiates communications with host computer 103 by sending a login packet, as indicated at step 405. Controller 201 then enters a wait state, waiting for a seed packet from host computer 103, as indicated at step 410. After the seed packet has been received, controller 201 at step 415 causes the meter to send a request packet to computer 103. Controller 201 then proceeds to step 420 where it enters another wait state, waiting for a response packet from computer 103. After the response packet has been received, controller 201 causes the meter to send an amount packet to computer 103, as indicated at step 425. The amount packet typically includes reset amount data for increasing the available postage in the meter or, in other words, the value of the descending register. Controller 201 at step 430 enters yet another wait state, waiting for a grant packet from computer 103. After the grant packet has been received, controller 201 updates the meter with data including the above-described limits in the received grant packet, as indicated at step 435. If the TMS transaction has proceeded without a problem, controller 201 at step 440 causes the meter to send a logout packet to computer 103.

However, if controller 201 during the transaction detects any such condition as depression by the meter user of an abort button, a receipt of a quit message from data center 15, a modem problem or a general transmission problem, the established communications between the meter and computer 103 would be aborted. As a result, any data previously received by the meter is discarded, the meter returns to the initial meter state, the user is then informed of the termination of the communications, and any termination message from the data center is displayed through display 215.

Figure 5A:
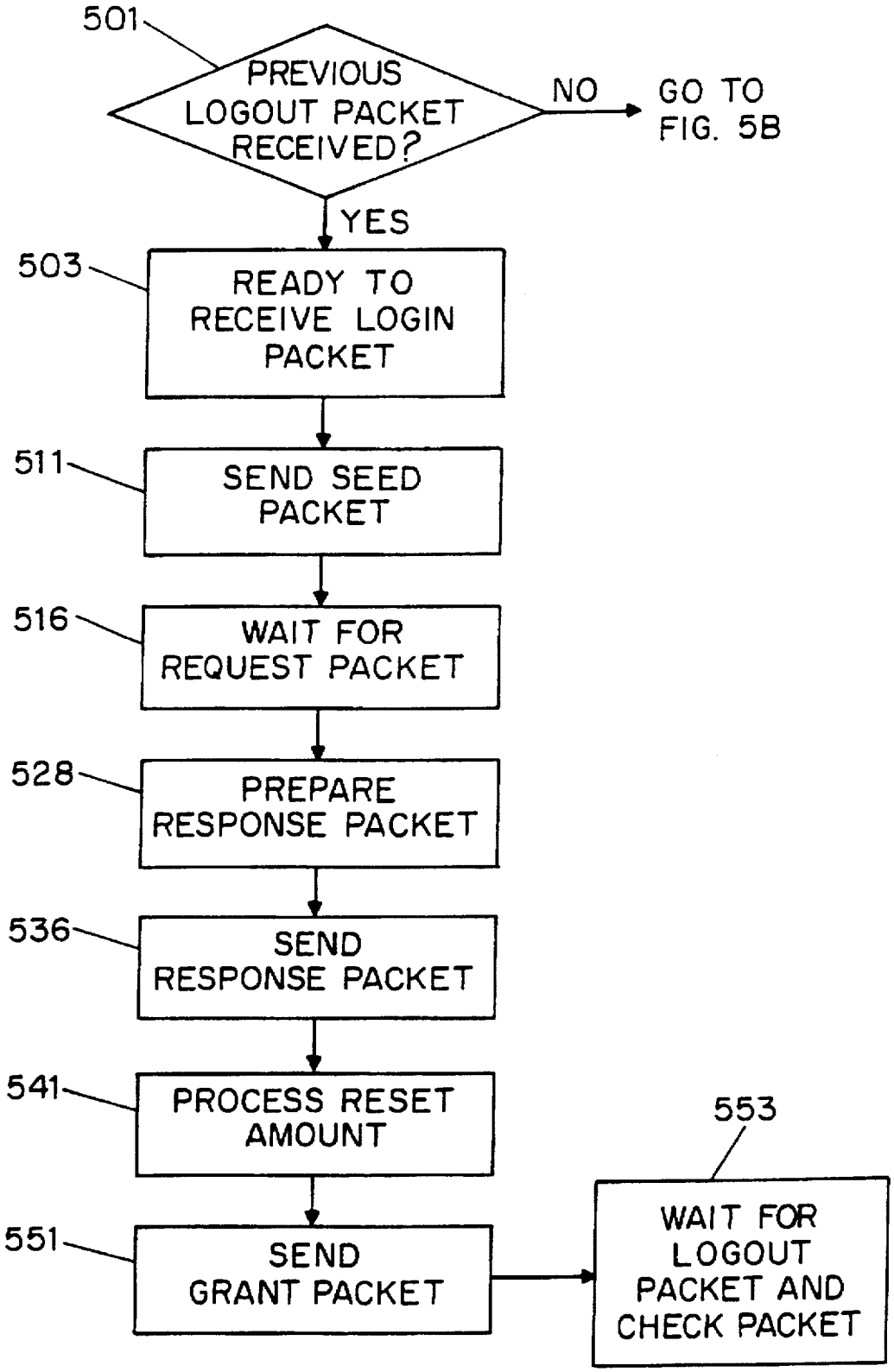
FIGS. 5A and 5B are a combined flow chart illustrating a routine performed by a host computer in the data center for conducting the TMS transaction with the meter in accordance with the invention.
Figure 5B:
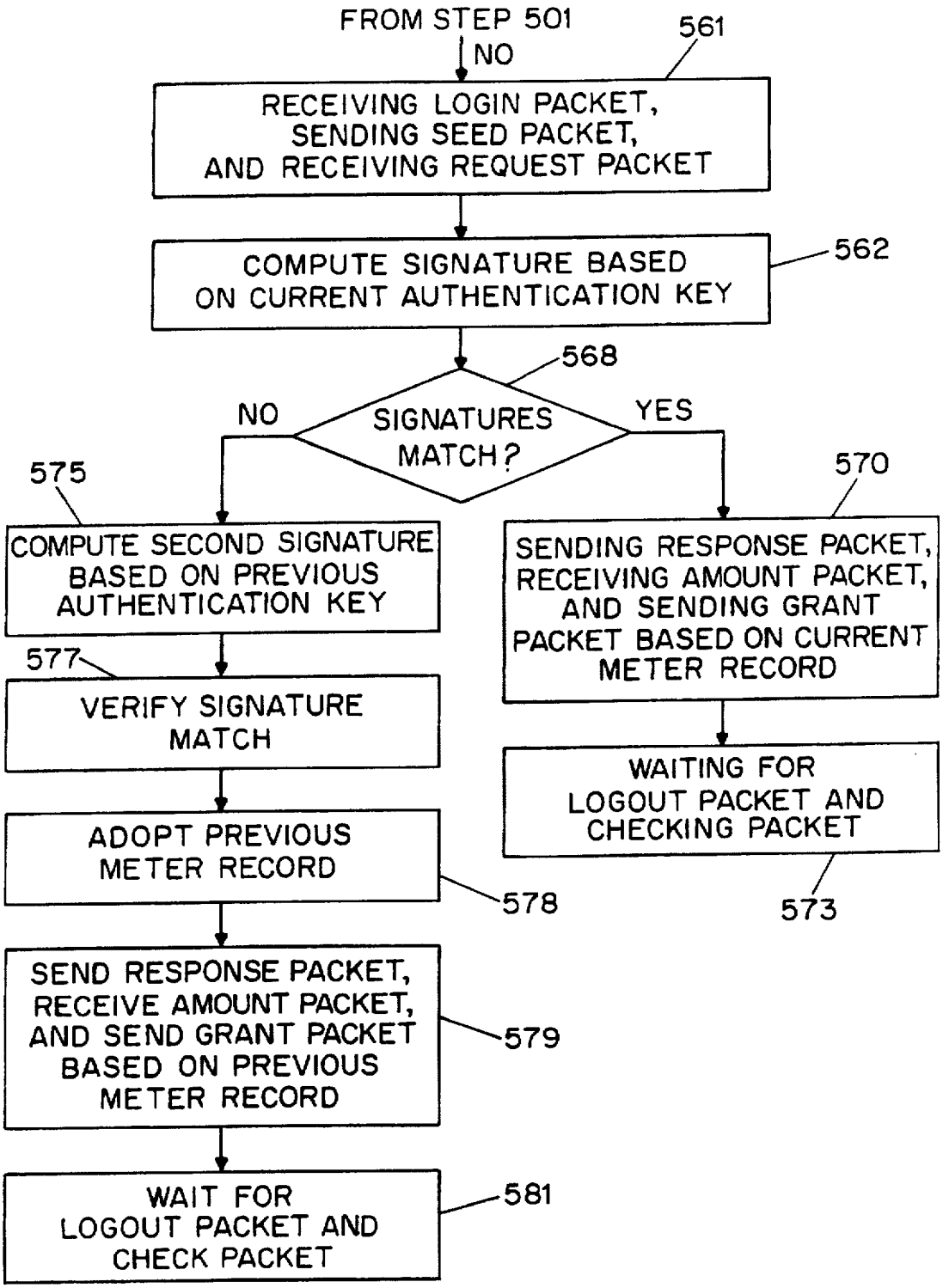

FIGS. 5A and 5B combinedly illustrate a flow chart describing a routine on host computer 103 for conducting a TMS transaction with one of postage meters 101-1 through 101-p in accordance with the invention. When a TMS transaction is initiated by a meter, instructed by the routine on computer 103, the latter checks at step 501 whether any logout packet was received in the last communication session with the meter in question. If computer 103 determines that such a logout packet was not received, which indicates that the last communication session was incomplete, the routine proceeds to perform the steps in FIG. 5B to be described. Otherwise if the logout packet was received, computer 103 instead proceeds to step 503 where it is ready to receive a login packet from the meter. When computer 103 receives such a packet, it responsively sends a seed packet to the meter, as indicated at step 511. Computer 103 at step 516 then waits for a request packet from the meter. Once the request packet is received, computer 103 at step 528 prepares a response packet. As further described hereinbelow, the response packet includes a control command field which may indicate to the meter to change its various charge classes, etc. Computer 103 at step 536 sends the response packet to the meter and waits for an amount packet in return. After the amount packet is received, computer 103 at step 541 processes the reset amount therein requested by the meter. Computer 103 may reduce the amount limit of the meter if the user's account balance has insufficient funds to cover the requested amount. Otherwise, computer 103 deducts the requested amount from the user's account. Computer 103 then sends at step 551 a grant packet to the meter and indicates a new postage amount limit, i.e., the new maximum value up to which the ascending register of the meter may reach. Computer 103 thereafter proceeds to step 553 where it waits for a logout packet from the meter and checks data (including, e.g., a logout message) in the logout packet, if received. It should be noted at this point that host computer 103 retains full control of terminating the communication session at any time. In particular, computer 103 would terminate its session with the meter when, for example, it detects any error in the received packets, a defect in the meter's database, insufficient funds in the user's account to cover the requested amount, etc. The termination by computer 103 is accomplished by sending a quit message and then returning to step 501. Such a termination results in a simple rollback whereby both meter and the data center return to their initial states as if the current communication session had never happened.

Turning to the flow chart of FIG. 5B, after determining that the logout packet was not received in the last communication session, computer 103 proceeds to step 561 including the substeps of receiving the login packet from, sending the seed packet to and receiving the request packet from the meter, as described in FIG. 5A. However, since the logout packet was not received which may be due to power interruption during the last communication session, computer 103 is unsure of whether the meter managed to update its registers and buffers. As such, without destroying the previous meter record including the authentication key received in the last communication session, computer 103 provisionally uses the current meter record including the authentication key received in the current communication session to verify whether a signature in the request packet is valid. As noted before, the signature is particular to the authenticated data in the request packet. Based on the received data, and the current authentication key, computer 103 at step 562 independently computes a signature. At step 568, Computer 103 compares the computed signature with the received signature. If the two signatures match, computer 103 adopts the current meter record and proceeds to perform step 570 including the substeps of sending a response packet to, receiving an amount packet from and sending a grant packet to the meter based on the current meter record. Computer 103 then proceeds to step 573 where it waits for a logout packet from the meter and checks the data in the logout packet, if received. However, if the computed signature is determined to be different from the received signature at step 568, computer 103 proceeds to step 575 where a second signature is computed using the previous authentication key. At step 577, computer 103 verifies that the second signature matches the received signature. This indicates that the previous communication session was substantially disrupted and incomplete. Computer 103 responsively starts a reversal process including adopting the previous meter record, as indicated at step 578. Computer 103 then proceeds to perform step 579 including the substeps of sending a response packet to, receiving an amount packet from and sending a grant packet to the meter based on the previous meter record. Computer 103 thereafter proceeds to step 581 where it waits for a logout packet from the meter and checks the data in the logout packet, if received.

The protocol of the above communications between host computer 103 and one of the meters involving the various packets will now be described. In a conventional manner, each packet includes a data portion enclosed by a header, a trailer, and/or other standard overhead necessary for transmission and routing of the packet in system 10.

As mentioned before, the very first packet transmitted by a meter to computer 103 during the session is the login packet. The data portion of this packet contains one byte character which specifies the protocol version in which the communications are carried out.

The seed data packet transmitted by computer 103 contains a zz number which is eight bytes long. This number is a random number generated by computer 103 and is used by the meter to calculate a CBC initialization vector for encryption purposes.

It should be pointed out at this juncture that, in this illustrative embodiment, the data of the various packets for communications is selectively encrypted and/or authenticated using a CBC mode of DES cryptography. As is well-known in the art, the CBC mode operates on a data byte sequence in blocks, each of which includes eight bytes. The CBC mode encrypts a data block based on the eight data bytes in the block, a DES key, and a third value, which is a function of the previous block. This repetitive encryption, called chaining, hides repeated patterns. In addition, all the DES keys here, whether for encryption or authentication, are secret keys and kept from public knowledge.

In this particular illustrative embodiment, the CBC encrypted version of the current data block D. is expressed as a function: DES(Key, $D_n$+$E_{n-1}$), where DES represents the DES CBC cryptographic function; Key denotes a selected DES key; n=0, 1, 2 . . . , and $D_0$ represents the first data block; and $E_{n-1}$ denotes the CBC encrypted version of the preceding data block. It is apparent that $E_{n-1}$ when n=0 is indeterminate, and a CBC initialization vector is thus required for the initial value of $E_{n-1}$ for n=0 to start the chaining process.

When the CBC is applied for authentication of a number of data blocks, the CBC operates on the data blocks in the same manner as it encrypts them. The encrypted version of the last data block $E_{last}$ is used to generate a signature, which can be expressed as DES(Key, $E_{last}$).

Illustratively, the CBC initialization vector k2 for encryption of certain data in the request packet selectedly comprises eight bytes representative of DES(Key=loginID, zz). The "loginID" is an individual login key for a meter. The loginID must not be a so-called weak or semi-weak DES key to be described. Data center 15 detects an invalid request packet if both the meter and data center do not use the same loginID. An additional safety measure is put in place here to require a quick calculation of an immediate response function value for zz. Specifically, the request packet is required to be sent to data center 15 within a predetermined, short time period from the transmission by center 15 of the seed packet to the meter. With such a short time window, it is virtually impossible for an unauthorized meter user to prepare a valid request packet including correctly encrypted request data, given the fact that zz is generated in real-time at the data center. The initialization vector k2 changes in each communication session with computer 103.

Figure 6A:
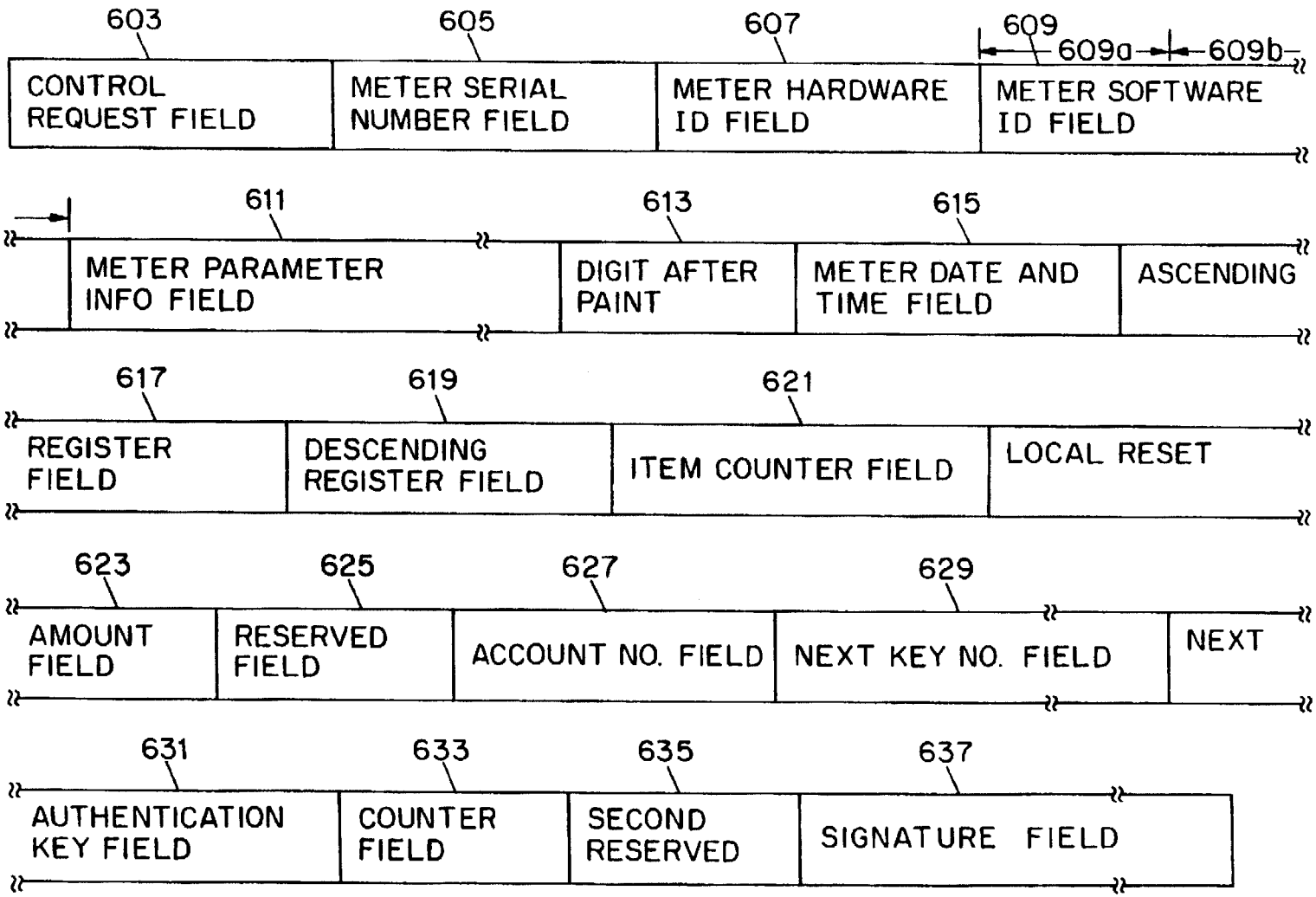
FIG. 6A is a block diagram illustrating a data format of a request packet communicated by the meter to the data center.

FIG. 6A illustrates the data format of the request packet. In this packet, control request field 603 includes two bytes of flags for informing computer 103 of a specific procedure for which the meter is ready, including the types of remote control that the meter applies and data that may be transmitted. To this end, bit 15 of field 603 is associated with remote meter setting; bit 14 is associated with remote counter reading; bit 13 is associated with remote configuration; bit 12 is associated with remote statistics; bits 8 through 11 are currently reserved. In this illustrative embodiment, bits 8 through 15 are designated the control byte, and bits 0 through 7 are designated as the subcontrol byte. FIG. 6B is a table for looking up the control requests (R) specified in control request field 603, and control commands (C) specified in a control command field of the response packet to be described. It suffices to know for now that the control request defines what sort of control the meter expects at the moment of transmission. The actual control command to be executed is transmitted by computer 103 in response to the control request. Similar to control request field 603, the control command field includes a control byte and a subcontrol byte, and for some requests R, computer 103 may respond thereto with a selected one of several commands C. For example, in row 681 of the table of FIG. 6B, the control byte of field 603 having a value of 90 (hexadecimal) and a subcontrol byte having a value of 01 (hexadecimal) indicates a control request for remote meter resetting, and statistics reading, i.e., reading of the class statistical data from the meter. In response to this request, computer 103 may generate a response packet as shown in row 683—a control command field having a control byte of 90 (hexadecimal) and a subcontrol byte of 01 (hexadecimal)—indicating a meter resetting and statistics command and preservation of previous statistics class definitions. Alternatively, as shown in row 685, a control byte of B0 (hexadecimal) and a subcontrol byte of 01 (hexadecimal) indicate a command for (1) remote meter resetting, (2) class configuration (i.e., defining new charge classes) and (3) statistics reading from the meter.

In accordance with another aspect of the invention, a meter user may request through control request field 603 a refund for unused postage indicated by the descending register of the meter. To this end, the control and subcontrol bytes should be set to 80 (hexadecimal) and 02 (hexadecimal), respectively, as shown in row 687. The request amount in the amount packet subsequently sent to data center 15 should be a negative value such that it would nullify the descending register (i.e., the request amount+the current descending register value=0). In response to such a refund request, data center 15 credits to the user's account the unused postage amount at the end of the transaction.

Similarly, when a meter user surrenders a meter to an authority, the unused postage will be refunded. In addition, the meter will be disabled to prevent an unauthorized access to the meter. Such surrender of the meter can be achieved by specifying the control and subcontrol bytes of control request field 603 to be 80 (hexadecimal) and 03 (hexadecimal), respectively, as indicated in row 689. In a postpayment scheme where no refund is required in the surrender of the meter, such surrender may be accomplished by setting the control and subcontrol bytes of control request field 603 to be 40 (hexadecimal) and 03 (hexadecimal), respectively, as indicated in row 691. With this setting, the authority is able to read the counters in the meter the last time before the meter is disabled to prevent an unauthorized access thereto.

Referring back to FIG. 6A, meter serial number field 605 includes five bytes representing a serial number for uniquely identifying the meter. This number, when transmitted, is not encrypted as computer 103 relies on the serial number to look up the current decryption keys for the meter in question.

Meter hardware ID field 607 includes four bytes for identifying the meter's shape, style, model, printed circuits, and other details of its hardware. Computer 103 may utilize the hardware information for advertisement or compilation of statistics.

Meter software ID field 609 includes sixteen bytes for identifying the current version of the meter software, thereby updating computer 103 on any model modification of the meter. Field 609 comprises subfield **609*a* containing eight bytes of ASCII text representative of the meter's main software version, and subfield 609*b* containing the other eight bytes of ASCII text representative of a country specific software version. With the information provided by field 609, computer 103** recognizes the software capabilities of the meter and thereby works effectively with the meter to generate advertisements or announcements on the meter, compile statistics, and so on and so forth.

Meter parameter info field 611 includes twelve bytes representative of configuration data. Specifically, four bytes are reserved for future, additional identification of the meter's configuration. A fifth byte identifies the language in which the internal text of the meter for display is written. A sixth byte identifies the country in which the meter is located. A seventh byte identifies the display type. An eighth byte indicates number of lines of text in one display. A ninth byte indicates number of characters in one display line. A tenth byte identifies the user's printer type. Eleventh and twelfth bytes consist of sixteen flag bits indicating what devices are connected to the meter and active. For example, flag bit 0, when high, indicates a connection to an active test module for testing the meter. Flag bit 1, when high, indicates a connection to an active PC. Flag bit 2, when high, indicates a connection to an active internal printer. Flag bit 3, when high, indicates a connection to an active external printer. Flag bit 4, when high, indicates a connection to an active postal scale. Flag bits 5 through 15 are currently reserved for other peripheral devices. With the information provided by field 611, computer 103 realizes the actual arrangement of the meter and thereby works effectively with the meter to generate advertisements or announcements on a printer, compile statistics, and so on and so forth. For example, having determined that the external printer to the meter is active, computer 103 may send a text file to the meter to be printed on the external printer, which includes TMS news and the current account balance.

Digits after point field 613 includes one byte indicating number of digits allowed after a decimal point, or the position of the decimal point from the right-most of a sequence of digits.

Meter date and time field 615 includes six bytes. Byte 5 identifies the current year; byte 4 identifies the current month; byte 3 identifies the current day; byte 2 identifies the current hour; byte 1 identifies the current minute; and byte 0 identifies the current second. Such date and time is set in accordance with the standard Greenwich Mean Time (GMT). In fact, all the time and date information communicated in system 10 is in general based on GMT.

Ascending register field 617 includes six bytes representative of individual digits of the current value of the ascending register. The information from digits after point field 613 enables computer 103 to determine the position of the decimal point among these individual digits. This being so, computer 103 can determine the exact value of the ascending register.

Descending register field 619 includes five bytes representative of individual digits of current, available postage amount for metering. Again, with the information from digits after point field 613, computer 103 can determine the exact value of the amount. The descending register value here may be derived by way of computation, i.e., the current postage amount limit less the ascending register value.

Item counter field 621 includes five bytes representative of number of mail items which were metered.

Local reset amount field 623 includes five bytes representative of amounts of resets conventionally performed at the postal authority when the meter is physically brought there, and serves as confirmation that local resets occurred. Thus, this illustrative embodiment conveniently allows for local resets as well as remote resets.

Reserved field 625 includes five bytes reserved for future use.

Account number field 627 includes four bytes representative of the number of a pre-established account with data center 15 with which TMS transactions are conducted. Since the account number is confidential, the four bytes within field 627 are encrypted in accordance with the DES CBC cryptographic algorithm previously described.

Next keynumber field 629 includes eight bytes representative of the DES key which will be used in the next communications session. This key takes the form of a pseudo random number generated by the meter and, again, may not be a weak or semi-weak DES key. FIG. 7A is a table listing four examples of the weak DES keys; and FIG. 7B is a table listing twelve examples of the semi-weak keys. The encryption key in field 629 is also encrypted.

Next authentication key field 631 includes eight bytes representative of an authentication key which will be used in the next communications cycle. However, this authentication key must not be dependent on or a derivative of the encryption key of field 629. It also takes the form of a pseudo random number generated by the meter and may not be a weak or semi-weak DES key. In addition, this key is encrypted.

Counter field 633 includes two bytes representative of a count keeping track of the communication session the meter and computer 103 are in. It restarts at 0 after 65,535 is reached. The count is important for detection by computer 103 of occurrences of reversals, and is also encrypted.

Second reserved field 635 includes two bytes for future use which are encrypted.

The final field of the request packet is signature field 637 including eight bytes representative of a signature resulting from authentication of the data in each data field, except field 637, of the request packet, in accordance with the above-described DES CBC cryptographic algorithm. Unlike the CBC initialization vector for encryption purposes, the CBC initialization vector for authentication is set to be zero. With the authentication, the signature changes if any authenticated data is modified. After receiving the request packet, computer 103 first calculates the signature based on the authenticated data in the packet and verifies the authenticity thereof by comparing the calculated signature with the received signature. The encrypted data is then decrypted using the inverse DES function.

The CBC initialization vector for encryption of certain data in the above response packet selectedly comprises eight bytes resulting from a bit-wise XOR (Exclusive-OR) addition of the above vector k2 to 1.

It should be noted at this point that where, as an alternative, the downcounting timer and downcounting piece counter are used to carry out the time-limit and piece-limit concepts as previously described, two fields may be added to the data format of the request packet of FIG. 6A. For the information of data center 15, these additional fields may contain data representative of the current run time and piece count, respectively. Such additional fields may be treated similarly to descending register field 619 and authenticated as well.

Figure 8:
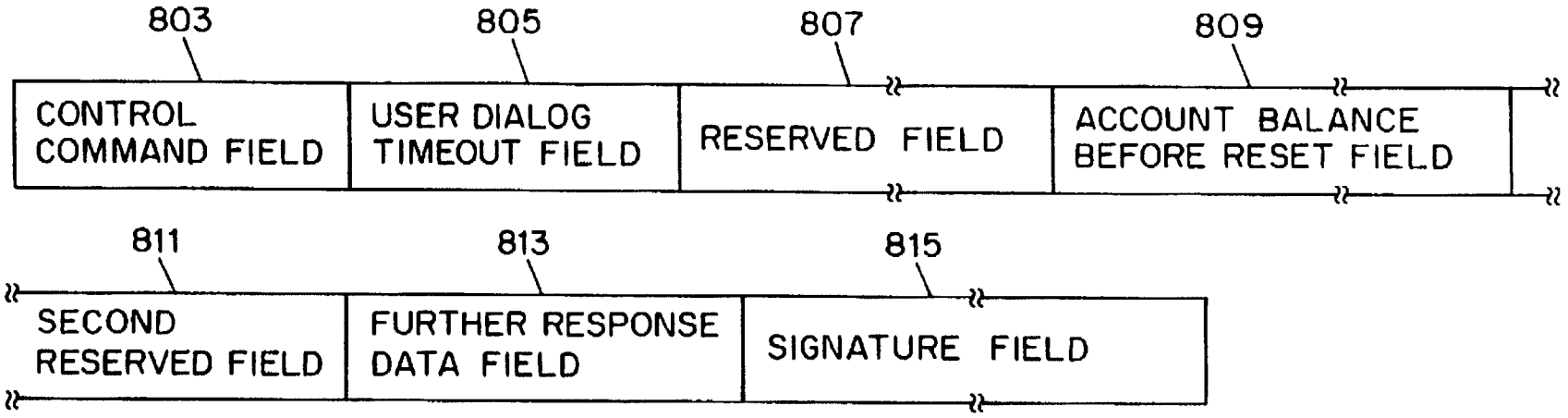
FIG. 8 is a block diagram illustrating a data format of a response packet communicated by the data center to the meter.

FIG. 8 illustrates the data format of the above response packet. In this packet, control command field 803 includes two bytes of flags having a format similar to the control request field 603 which is fully described hereinbefore. These flags are indicative of various control commands from data center 15 as illustrated in the table of FIG. 6B.

User dialog timeout field 805 includes one byte representative of number of seconds. Based on this data, the receiving postage meter sets its user timeout. That is, the user is given a time window within which the user needs to react to information sent by center 15.

Reserved field 807 includes five bytes for future use. The default value of this field may be set to zero.

Account balance before reset field 809 includes six bytes representative of a funds amount currently available on the user's account. This field is encrypted because the funds amount is considered confidential.

Second reserved field 811 includes two bytes for future use. Again, the default value of this field may be set to zero.

Further response data field 813 contains additional response data of a variable length. The structure of field 813 is referred to as a "dynamic data structure" and is fully described hereinbelow. In any event, the data in field 813 may be encrypted and/or authenticated depending upon the nature of the data.

Signature field 815 includes eight bytes representative of a signature resulting from authenticating selected data within the response packet, in accordance with the above-described DES CBC cryptographic algorithm. Again, the CBC initialization vector for authentication here is set to be zero.

Figure 9:
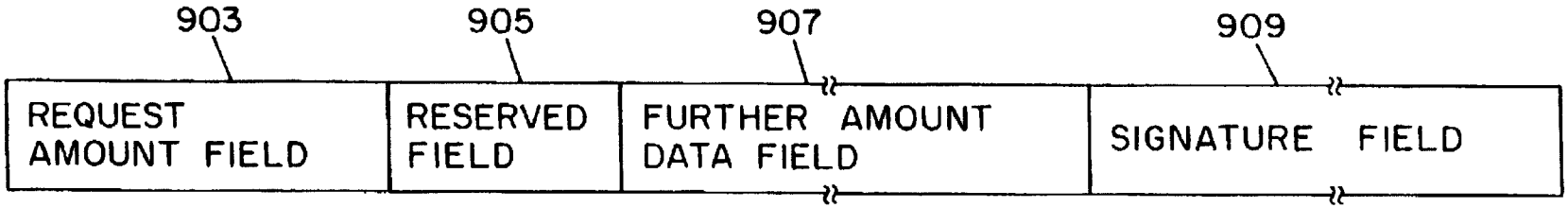
FIG. 9 is a block diagram illustrating a data format of an amount packet communicated by the meter to the data center.

The CBC initialization vector for encryption of certain data in the above amount packet selectedly comprises eight bytes resulting from a bit-wise XOR (Exclusive-OR) addition of the above vector k2 to 2. FIG. 9 illustrates the data format of the amount packet. In this packet, request amount field 903 includes five bytes representative of a reset amount requested, i.e., additional postage to be made available at the meter. This requested amount is encrypted.

Reserved field 905 includes three bytes for future use and is encrypted. The default value of this field is zero.

Further amount data field 907 contains additional amount data of a variable length in the dynamic data structure to be described. In any event, the data in field 907 may be encrypted and/or authenticated depending upon the nature of the data.

Signature field 909 includes eight bytes representative of a signature resulting from authenticating selected data within the amount packet, in accordance with the above-described DES CBC cryptographic algorithm. Again, the CBC initialization vector for authentication here is set to be zero.

Figure 10:
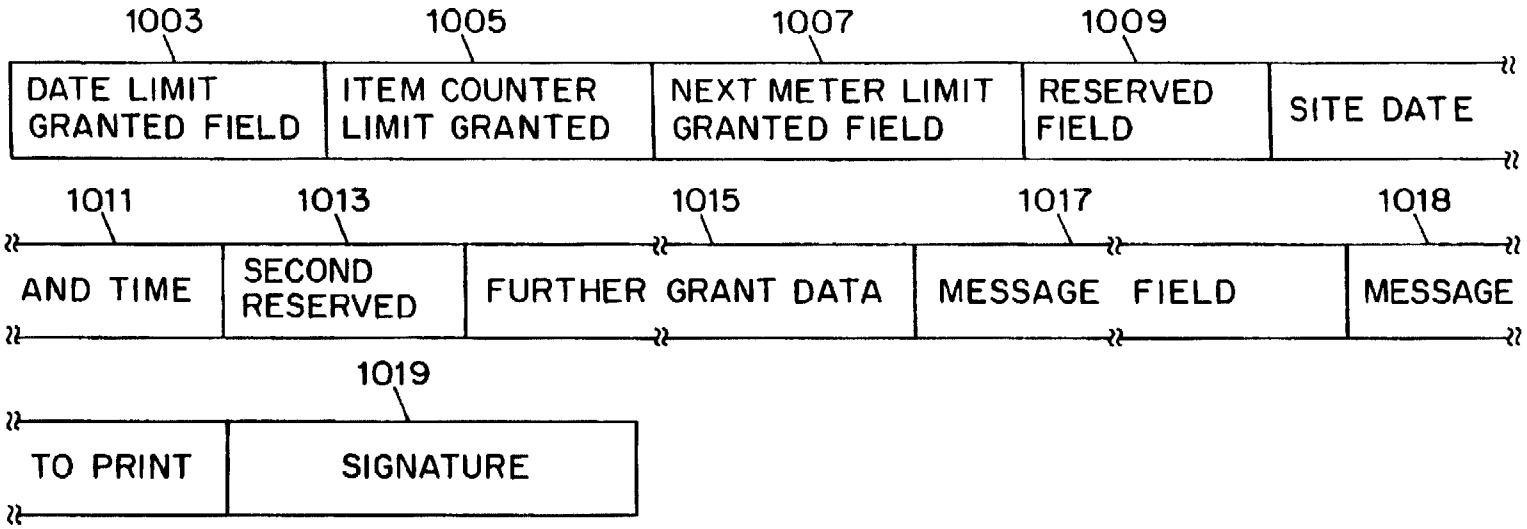
FIG. 10 is a block diagram illustrating a data format of a grant packet communicated by the data center to the meter.

The CBC initialization vector for encryption of certain data in the above grant packet selectedly comprises eight bytes resulting from a bit-wise XOR (Exclusive-OR) addition of the above vector k2 to 4. FIG. 10 illustrates the data format of the grant packet. In this packet, date limit granted field 1003 includes three bytes representative of a future date limit after which the meter will be locked and become inoperative. Specifically, byte 2 identifies the year of the date limit; byte 1 identifies the month; and byte 0 identifies the day. The limit is reached at midnight of the date so identified. The data in field 1003 is encrypted.

Item counter limit granted field 1005 includes five bytes representative of the piece limit for the number of mail items to be processed by the meter. The meter will be locked and become inoperative after this limit is reached. The limit is set according to predetermined increments defined at data center 15. The data in field 1005 is encrypted.

Next meter limit granted field 1007 includes six bytes representative of a new postage amount limit for the ascending register. Again, the meter will be locked and become inoperative after this limit is reached. The limit is determined based on the received ascending register value in field 617, the request amount information in field 903, and current available funds in the user's account. The data in field 1007 is encrypted. The new postage amount limit is intended to replace the current postage amount limit previously communicated to the meter. This new postage amount limit is greater than the current postage amount limit by the requested reset amount, provided that the funds in the user's account can cover the requested reset amount. As such, the postage amount limit is ever increasing; so is the value of the ascending register in the meter. However, the ascending register value can never exceed a physical limit that the register physically allows. This being so, the new postage amount limit can never be greater than the physical limit in question. When the new postage amount limit would otherwise exceed the physical limit, the meter is required to be serviced for adjustment of the ascending register so that the new postage amount limit can be set well below the physical limit.

Reserved field 1009 includes two bytes for future use and is encrypted. The default value of this field is set to zero.

Similar to the format of meter data and time field 615 previously described, site date and time field 1011 includes six bytes representative of a time reference used to set the meter's date and time to correct values. Again, this time reference is in accordance with the standard GMT.

Second reserved field 1013 includes two bytes for future use. This field is set to a default value zero.

Further grant data field 1015 additional grant data of a variable length in the dynamic data structure to be described. In any event, the data in field 1015 may be encrypted and/or authenticated depending upon the nature of the data.

Message field 1017 provides for an unlimited number of bytes necessary for representing a display message from data center 15. The message is terminated by predetermined characters (#0 in this instance). This message is neither encrypted nor authenticated so that the user can read it even in case of encryption/authentication errors. The message is formatted by computer 103 according to the meter's display type/dimensions previously communicated thereto in meter parameter info field 611.

Message to print field 1018 provides for an unlimited number of bytes necessary for representing a message for a printer associated with the meter to print. The message is terminated by predetermined characters (#0 in this instance), and sent only when the printer is active. This message is neither encrypted nor authenticated so that the user can read it even in case of encryption/authentication errors. The message is formatted by computer 103 according to the printer type previously communicated thereto in meter parameter info field 611.

Signature field 1019 includes eight bytes representative of a signature resulting from authenticating selected data within the grant packet, in accordance with the above-described DES CBC cryptographic algorithm. Again, the CBC initialization vector for authentication here is set to be zero.

It should be noted at this point that where, as an alternative, the downcounting timer and downcounting piece counter are used to implement the time-limit and piece-limit concepts as previously described, the data in date limit granted field 1003 should represent an amount of time instead of a date. After receiving such time-limit data from field 1003 and the piece limit data from field 1005, the meter adds the time limit and the piece limit to the current run time of the downcounting timer and the current piece count of the downcounting piece counter, respectively.

It should also be noted at this point that, based on the request packet from the meter including information in item counter field 621, and the limits including the piece limit previously communicated to the meter, data center 15 is capable of determining whether one of these limits has been reached. Data center 15 assumes that the meter is locked from further operation when any limit is determined to have been reached. New limits allowing the meter to resume its operation are communicated in fields 1003, 1005, and 1007 of the grant packet only when certain predetermined conditions are satisfied. Such conditions include, for example, the meter components being in good order, the meter not being reported stolen, and no payment to the postal authority being overdue where the postpayment scheme is implemented.

Figure 11A:
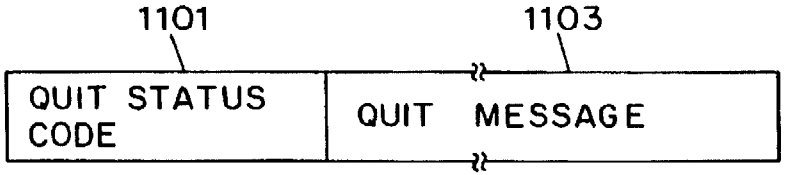
FIG. 11A is a block diagram illustrating a data format of a quit packet communicated by the data center to the meter.

FIG. 11A illustrates the data format of the above quit packet generated by computer 103 when it for any reason decides to quit during the communications with the meter. In this packet, quit status code field 1101 includes two bytes identifying a quit status, to which the meter's application may react.

Like message field 1017, quit message field 1103 provides for an unlimited number of bytes necessary for representing a display message from data center 15. The message is terminated by predetermined characters (#0 in this instance). This message is neither encrypted nor authenticated so that the user can read it even in case of encryption/authentication errors. Because center 15 when quitting may not yet be informed of the meter's display type/dimensions, the quit message is normally simple and unformatted.

Figure 11B:
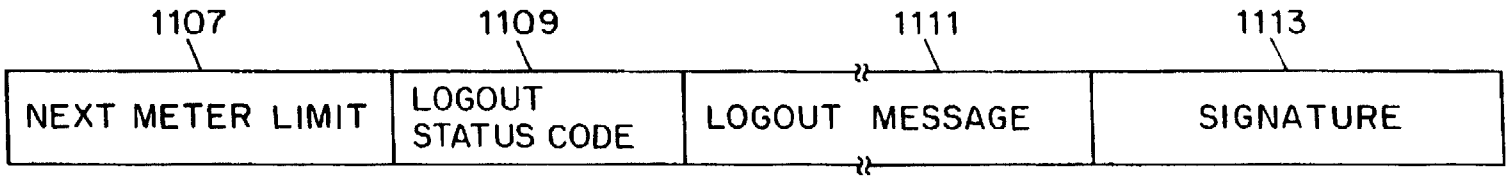
FIG. 11B is a block diagram illustrating a data format of a logout packet communicated by the meter to the data center.

FIG. 11B illustrates the data format of the above logout packet. This packet is generated by a meter for confirmation of a complete communication session with data center 15 to assure the latter that no reversal is necessary in the next communication session. In this packet, next meter limit field 1107 includes two bytes repeating the content of next meter limit granted field 1007 in the received grant packet. Logout status code field 1109 is formatted and functions similarly to quit status code field 1101 described before. Logout message field 1111 is formatted and functions similarly to quit message field 1103 described before. Signature field 1113 includes eight bytes representative of a signature resulting from authenticating the data in each field except logout message field 1111.

As mentioned before, further response data field, further amount data field, and further grant data field, if necessary, may contain additional data which is in the dynamic data structure. FIG. 12 illustrates one such data field 1200 in the dynamic data structure. The data in field 1200 can be fully/partially encrypted and/or fully/partially authenticated. Field 1200 starts with byte-pair 1201 comprising two bytes representative of a count of data elements (N) within field 1200. Byte-pair 1201 is followed by byte-pair 1203 representative of a number E, specifying that data parts (denoted data x's, where $1 \leqq x \leqq N$) of the first E data elements are encrypted. The next byte-pair 1205 representative of a number A, specifying that the first A data elements, in addition to byte-pairs 1201, 1203, 1205 and 1207, are authenticated. Byte-pair 1207 is reserved for future use. Following byte-pair 1207 are the N data elements. Each element starts with a length byte representative of number of bytes (Lx) in data x of the element. Thus, it can be shown that the length of field $$8 + N + \sum_{x=1}^{N} Lx$$

It should be pointed out that above byte-pairs 1201, 1203 and 1205 representative of the values N, E and A, respectively, and the length bytes may not be encrypted as they are needed for a length calculation before any decryption takes place.

In addition, due to the requirement of the DES CBC cryptographic algorithm, the length of each data part to be encrypted must be in a multiple of eight bytes. In the event that any data part to be encrypted is not in a multiple of eight, the data part is extended to the nearest multiple of eight by stuffing thereinto bytes having a value 0. The stuff-bytes are encrypted and transmitted as if they were actual data bytes. Cognizant of the Lx's indicative of the numbers of actual data bytes in the corresponding data parts, computer 103 is capable of determining which of the received bytes are stuff-bytes and hence ignores them after decryption.

For the authentication, a similar requirement as to the number of bytes being a multiple of eight in each data element to be authenticated applies. In the event that any data element to be authenticated does not comprise a multiple of eight bytes, virtual bytes having a value zero are temporarily added during authentication to achieve a length of the nearest multiple of eight. However, these virtual bytes are not transmitted. Nor do they actually appear in the data parts.

It should also be pointed out that the content of control command field 803 in the response packet may dictate the existence of further response data field 813 in the same packet, further amount data field 907 in the amount packet and further grant data field 1015 in the grant packet during the communication session. Specifically, when the control command field 803 contains a hexadecimal number 8001 indicative of standard remote meter resetting (see FIG. 6B), or 4001 indicative of standard remote counter reading, fields 813, 907 and 1015 are not needed for either function and thus omitted.

On the other hand, when the control command field 803 contains one of hexadecimal numbers 9001, B001, 5001 and 7001, indicating to the meter, among other things, to return statistical data to data center 15, further amount data field 907 is then set up in the subsequent amount packet from the meter to report such statistical data. FIG. 13 is a table describing the content of an exemplary further amount data field in the above-described dynamic data structure reporting class statistical data. As shown in FIG. 13, N=4 indicative of four data elements in the field; E=0 indicative of no encrypted data part, A=0 indicative of no authenticated data element. The first data element includes a data part of L1=3 bytes. The first two bytes of this data part represent charge class 0 which is a miscellaneous class. The third byte represents a non-zero statistical hit count (e.g., 175) of mail items which were processed by the meter and which belonged to charge class 0. Similarly, the second data element includes a data part of L2=4 bytes. The first two bytes of this data part again represent a class which is charge class 3 in this example. The third and fourth bytes represent another non-zero statistical hit count which is 9,278 in this example. The third and fourth data elements similarly indicate the statistical hits of classes 4 and 7, respectively. It is noteworthy that, in this example, classes such as 1, 2, 5, and 6 which have no hits are not represented so as to minimize the length of the further amount data field.

Figures 14, 15:
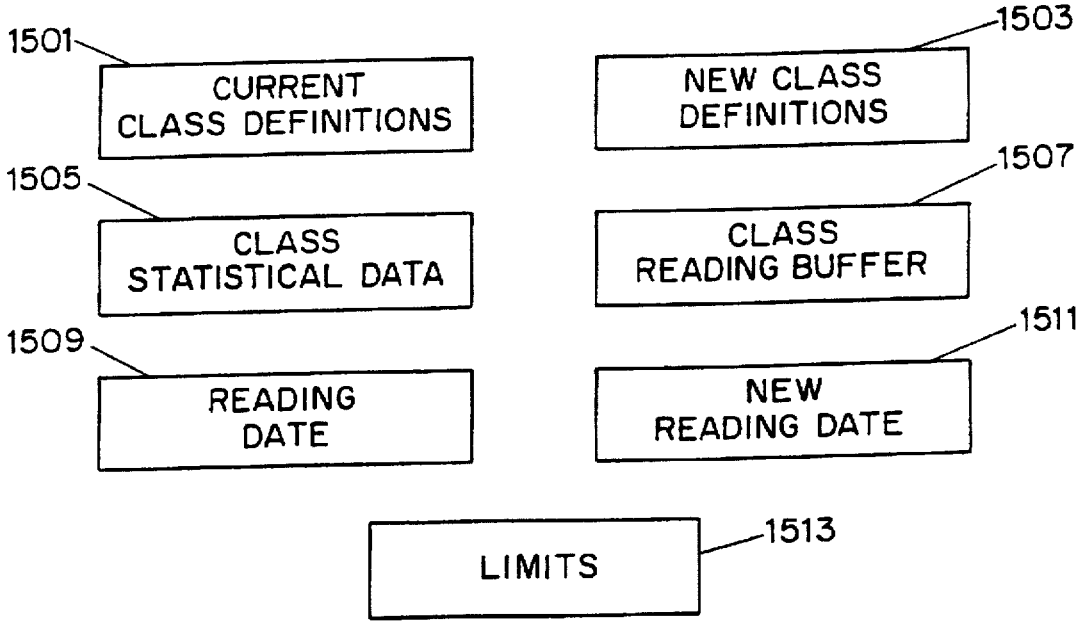
FIG. 14 is a table describing the content of an exemplary further grant data field in the dynamic data structure of FIG. 12.
FIG. 15 illustrates a set of buffers in the memory space of FIG. 3A.

When the control command field 803 contains one of hexadecimal numbers B001 and 7001, indicating to the meter, among other things, to redefine charge classes, further grant data field 1015 is then set up in the subsequent grant packet from data center 15 to convey information on the new class definitions. FIG. 14 is a table describing the content of an exemplary further grant data field in the above-described dynamic data structure conveying information including new charge class definitions. As shown in FIG. 14, N=S indicative of S data elements in the field, where S is a predetermined integer; E=0 indicative of no encrypted data part, A=S indicative of all data elements being authenticated. The first data element includes a data part of L1=6 bytes representative of a new reading date. The format of this data part resembles the format of meter date and time field 615 of the request packet described before. If the value of the data part is set to zero, the reading will take place in the upcoming communication session between the meter and data center 15, provided that the session is complete. The new reading date information specifies when the meter will implement the new classes as defined in the subsequent data elements. The second data element includes a data part of L2 bytes. The first byte in this data part identifies a mail class type of charge class 1 which, in this instance, is first class mail. Other mail class types include parcel post, express mail, international mail, etc. The rest of the data part is divided into two halves each consisting of (L2–1)/2 bytes. The first half defines the lower limit (inclusive) of charge class 1, and the other half defines the upper limit (inclusive) of same. Like the second data element, the third through $S^{th}$ data elements each identifies mail class types of charge classes 2 through S-1 using the first byte of the data part, and defines the lower and upper limits of the class using respectively the first and second halves of the remaining data part. It should be noted that charge class 0 is internally created by the meter to account for statistical hits that do not fall within any of the above-defined classes.

FIG. 15 illustrates a set of buffers in nv-RAM 230 in a postage meter which make up a database in the meter necessary for communications with data center 15. As shown in FIG. 15, buffer 1501 contains current class definitions. These class definitions are ordered in an ascending order, the class with the smallest value being first. Each class is defined by its lower and upper limit, in that order. Of course, if a class should be described with a single value, the lower and upper limits are set to that value.

Buffer 1503, structured identically to buffer 1501, contains new class definitions which are valid after a specified reading date. If the reading date is unspecified, it would be the date the meter is switched on. Again, if the reading date is set to zero, the reading will take place in the upcoming communication session, provided that the session is complete.

Buffer 1505 comprises individual class counters or piece counters corresponding to the class definitions. Each class counter is dynamically set up for a charge class in accordance with the class definitions. An additional class counter is always set up for charge class 0 described above. These class counters holds class statistical data including the numbers of hits in the respective classes.

Class reading buffer 1507, structured similarly to buffer 1505, holds class statistical data which is read from buffer 1505 on the specified reading date. Buffer 1509 contains the reading date in question. Buffer 1511 contains a new reading date. Thus, on the reading date, the class statistical data is read into class reading buffer 1507; the new class definitions are copied into buffer 1501; and the new reading date is copied into buffer 1509.

Buffer 1513 contains the values for the time limit, the upper amount limit and the piece limit. For a limit or a date which is not in use, a value 0 (all zeros) may be assigned thereto.

Figure 16:
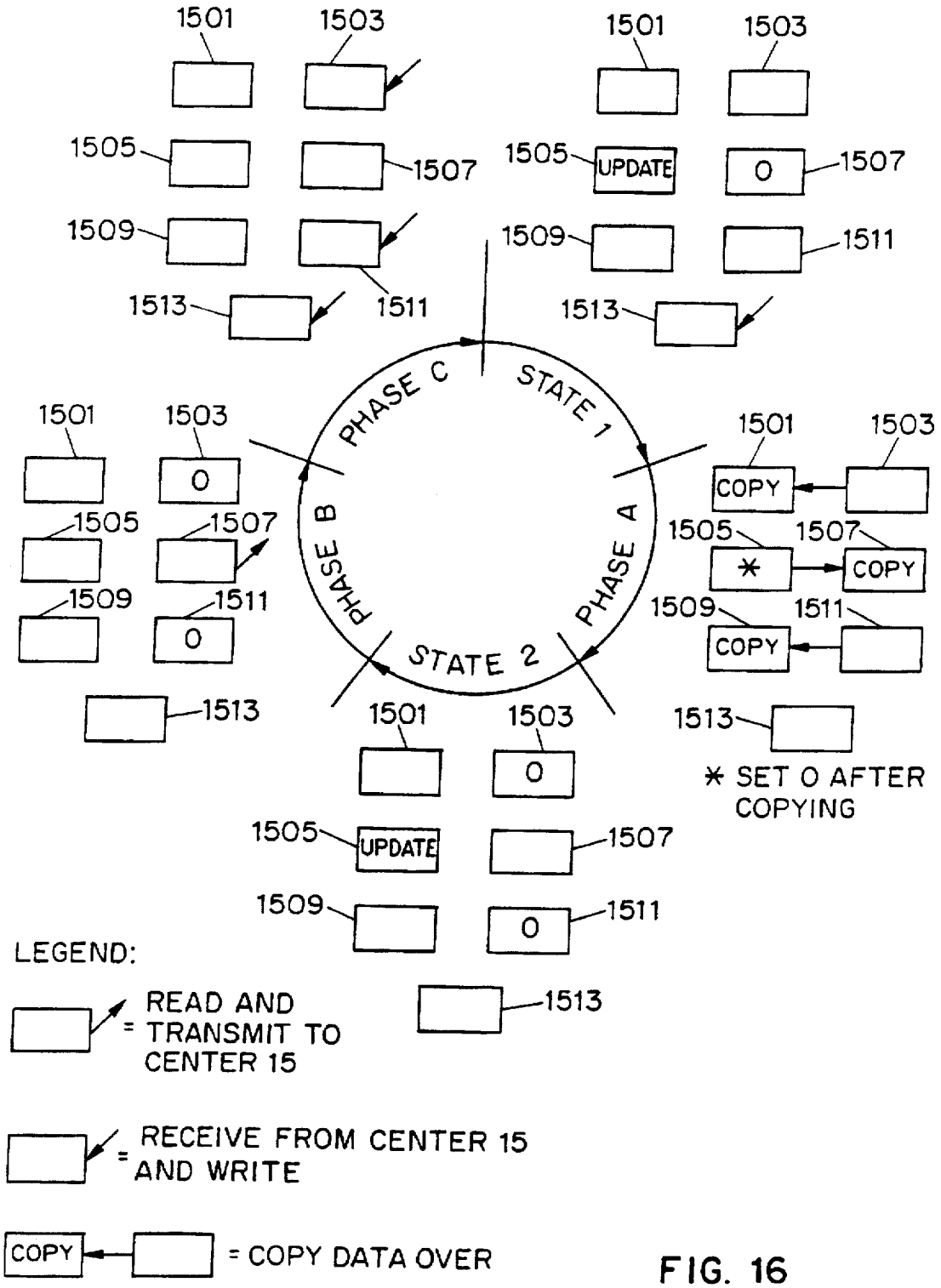
FIG. 16 illustrates an exemplary cycle through which the meter goes in carrying out its operation in accordance with the invention.

FIG. 16 illustrates an exemplary cycle through which a meter goes in carrying out its operation in accordance with the invention. The cycle comprises two states 1 and 2 interleaved with three phases A, B and C.

In state 1 where classes, new classes, the reading date, and the new reading date have been defined, while the meter is waiting for the reading date to expire, the class statistical data in buffer 1505 is being updated. In this state, buffer 1513 may be updated with new limits provided by data center 15. However, no class statistical data is transmitted. To this end, in a TMS transaction during this state, bit 12 of control request field 603 in the request packet transmitted from the meter must be set to zero.

The meter enters phase A when the reading date is reached. During this phase, the new class definitions in buffer 1503 are copied into buffer 1501; the class statistical data in 1505 is copied into class reading buffer 1507, and buffer 1505 is then cleared; the new reading date in buffer 1511 is copied into buffer 1509. The limits in buffer 1513 remain unchanged.

After phase A, the meter enters state 2, waiting for any TMS transaction during which transmission of the class statistical data to data center 15 is requested. As in state 1, in state 2, buffer 1505 is updated with new class statistical data.

The meter enters phase B from state 2 when the meter conducts a TMS transaction with data center 15. During the transaction, control request field 603 in the request packet would indicate (bit 12=1) a request for transmission of the class statistical data to data center 15. As previously described, such a request is normally acknowledged by the data center with a command in the response packet. The class statistical data in class reading buffer 1507 is then enclosed in an amount packet for transmission to data center 15.

Phase B is immediately followed by phase C wherein the class reading buffer is cleared. Data center 15 transmits to the meter a grant packet which may enclose new limits, a new reading date and new class definitions. These limits go into effect immediately after they are received by the meter. The meter then returns to state 1 to restart the cycle.

The foregoing merely illustrates the principles of the invention and those skilled in the art will be able to devise numerous arrangements which, although not explicitly shown or described herein, embody the principles of the invention.

Figure 17:
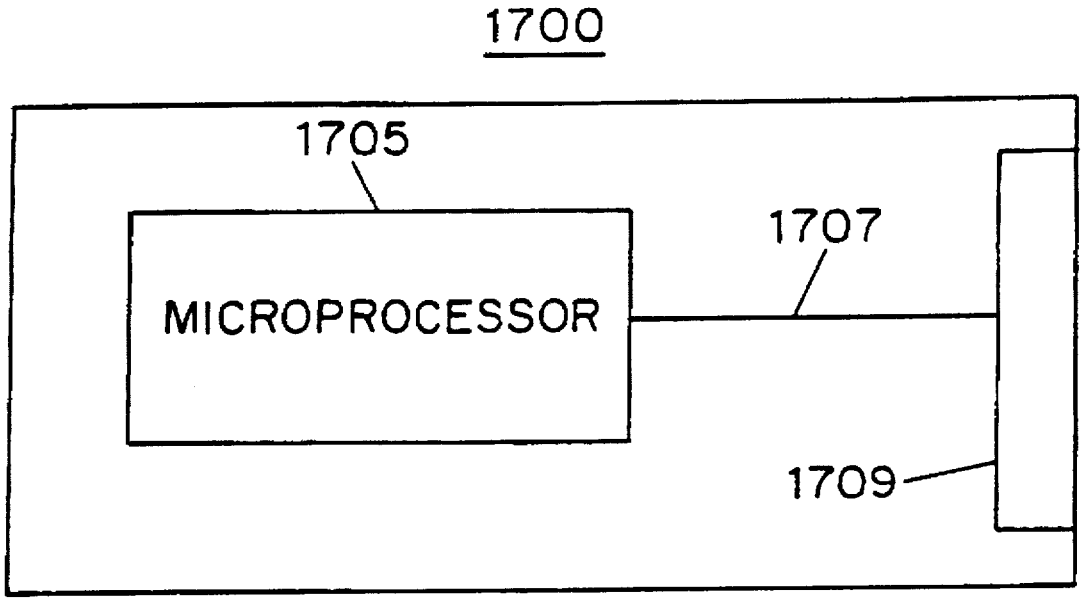
FIG. 17 is a block diagram of an integrated circuit (IC) card used in the system of FIG. 1.

For example, the above communications between postage meters 101-1 through 101-p and data center 15 are carried out in real time via dial-up telephone lines. It will be appreciated that a person skilled in the art may carry out similar communications off-line through an integrated circuit (IC) card of conventional design. FIG. 17 is a block diagram of IC card 1700 adapted for use in system 10. IC card 1700 includes microprocessor 1705 and leads 1707. Microprocessor 1705 includes a conventional memory (not shown) such as an EEPROM. It is important to note that the content in such a memory is erasable and can be overwritten. That is, the writings in such a memory are not irreversible so that, advantageously, the limited space of the memory can be reused. Leads 1707 are connected to microprocessor 1705 to transport data through input/output (I/O) interface 1709 on the card.

In order to accommodate IC card 1700, the meter of FIG. 2 needs to be modified to include an IC card connector having a slot receptive to the IC card. The card connector has an interface comprising metallic contacts for electrically connecting card 1700, when inserted in the slot receptacle, to controller 201 in the meter. The configuration of these metallic contacts complies with a well-known interface standard. Host computer 103 includes a similar IC card connector for card 1700 to communicate with the processor of computer 103. With the above arrangement, data can be transferred between IC card 1700 and the meter of FIG. 2 or host computer 103 when it is inserted in either slot receptacle.

The data contained in the memory of microprocessor 1705 complies with the data formats of the above-described packets. The sequence of the exchange of the packet data is similar to before. However, such an exchange is normally delayed due to the requirement of physically delivery (e.g., by courier) of the card back and forth between the meter and data center 15. In this alternative embodiment, IC card 1700 may act as a neutral card and contains only the seed packet data in memory 1705; it may act as a meter card and contains meter data; or as a center card and contains center data. To this end, a header file in memory 1705 identifies the card type. Referring to the cycle of FIG. 16, for example, in state 2, card 1700 is required to be a neutral card. After the meter computes based on the seed packet data on the neutral card, and writes the request, amount and logout packet data onto the card during phase B, it is redesignated as a meter card. The meter card is then delivered to data center 15.

After computer 103 in data center 15 reads the meter card, it overwrites the previous card data with center data including the response, grant and seed packet data for the next cycle onto the card which is then redesignated as a center card. In phase C, after the meter reads the center card, the card is cleared of data except the next seed packet data and becomes, again, a neutral card.

It is clear from the above discussion that IC card 1700 is merely used as a medium for data storage, and is run back and forth by a courier to transfer data between the meter and data center 15. That is, card 1700 here is not left inserted in the meter throughout the meter's postage printing operation to record data entries concerning, for example, the value and quantity of postage items printed during each postage printing transaction. In fact, card 1700 does not receive such data entries from the meter. Furthermore, card 1700 is not "smart" as it is not programmed to process any data received from the meter or data center 15.

In accordance with another aspect of the invention, the meter in phase C can only accept a center card but not a card otherwise designated. Thus, concomitant to the off-line communications, state 3 is needed between phases B and C, and represents the elapsed time for running the meter card to the center and the center card back to the meter. That is, state 3 starts at the moment of sending the meter card to the data center and ends at the moment of receiving by the meter of the center card. During state 3, buffer 1505 is updated with new class statistical data.

Finally, the exemplary embodiment of the invention is disclosed herein in a form in which various system functions are performed by discrete functional blocks. Without departure from the spirit and scope of the invention as set forth in the appended claims, these functional blocks may be implemented in various ways and combinations using logic circuitry and/or appropriately programmed processors, as will be known to those skilled in the art. As used in the following claims the term "directly" as applied to communications between a meter and a data center shall mean without human intervention.

We claim:

1. A postage meter device for printing postage of various values comprising:

an electro-mechanical element for processing mail items;

an input for selecting a value of postage for each of said mail items;

a processing element for defining at least one charge class with a first postage value being an upper bound and a second postage value being a lower bound;

said processing element associating a subset of said mail items with said at least one charge class based on postage values selected for said subset;

a counter for determining the number of mail items in said subset;

a memory buffer for storing statistical data including data representative of the number of said mail items; and a communications element for directly and electronically transmitting signals representative of said statistical data to an external data center.

2. The device of claim 1 wherein said at least one charge class is associated with a predetermined mail class type.

3. The device of claim 1 wherein said first postage value is equal to said second postage value.

4. The device of claim 1 wherein said subset of said mail items each have a selected postage value not higher than said first postage value and not lower than said second postage value.

5. The device of claim 1 further comprising means for storing said statistical data automatically in said buffer at a pre-selected time.

6. The device of claim 5 further comprising a second memory buffer for storing said pre-selected time.

7. A postage meter device for printing postage of various values comprising:

an electro-mechanical element for processing mail items;

a communications element for directly receiving at least one signal from an external data center, said signal representative of a piece limit restricting a number of mail items to be processed;

a memory buffer for storing the piece limit restricting a number of said mail items to be processed; and a mechanism responsive to the piece limit for stopping the processing of said mail items when said piece limit is reached.

8. A postage meter device for printing postage comprising:

an electro-mechanical element for dispensing postage;

a first memory buffer for providing a pre-selected value as a maximum postage limit up to which cumulative postage dispensed by the meter reaches;

a second memory buffer for storing a second value higher than said pre-selected value after non-zero postage has been dispensed;

a communications element for directly receiving at least one signal from an external data center, said signal representative of said second value; and a processing element for increasing said maximum postage limit from said pre-selected value to said second value.

9. A communications system comprising:

a plurality of postage meters for printing postage;

a data center comprising a communications element for directly communicating to a selected one of said postage meters at least one signal representative of at least a first postage value and a second postage value for defining at least one class in the selected meter, said meter further comprising:

an electro-mechanical element for processing mail items;

an input device for selecting postage for said mail items; and a processing element for associating a subset of said mail items with said at least one class based on postage values selected for said subset;

a counter for counting the number of items in said subset; and a memory buffer for storing statistical data reflecting the amount of said mail items processed by said postage meter which are associated with said at least one charge class.

10. The system of claim 9 wherein said at least one charge class is associated with a predetermined mail class type.

11. The system of claim 9 wherein said first postage value is equal to said second postage value.

12. The system of claim 9 wherein said subset of said mail items each have a selected postage not higher than said first postage value and not lower than said second postage value.

13. The system of claim 9 wherein said postage meter comprises a display for displaying messages, said communications element of said system further conveying to said meter messages for display by said displaying means.

14. The system of claim 9 wherein said processing element further generates data packets for communications with said postage meter.

15. The system of claim 14 wherein one of said data packets comprises at least one data field having a dynamic data structure, said data field including data and an indication indicative of a quantity of said data.

16. The system of claim 9 wherein said meter further comprises a communications element for directly transmitting to the data center a signal representative of said number of items at a pre-selected time.

17. The system of claim 16 wherein said communications element of said data center directly receives said signal.

18. The system of claim 16 wherein said meter further comprises a second memory buffer for storing said pre-selected time.

19. A communications system comprising:

at least one postage meter for processing mail items; and a data center comprising:

a communications element for directly communicating to said postage meter at least one signal representative of at least a time limit restricting a time period during which said mail items are processed by said meter, said meter further comprising a mechanism responsive to said signal for stopping processing of said mail items when said time limit is reached; and a processing element for determining whether the time limit previously communicated to said meter has been reached;

whereby when the previous time limit is determined to have been reached, said data center communicates a new time limit directly to said meter by said communications element to disengage the stopping means of said meter to resume processing of said mail items upon a satisfaction of one or more predetermined conditions.

20. The system of claim 19 wherein said time limit is defined by a pre-selected date.

21. The system of claim 19 wherein said postage meter comprises a display for displaying messages, said communications element of said system further directly communicating to said postage meter messages for display by said displaying means.

22. The system of claim 19 wherein said processing element further generates data packets for communications with said postage meter.

23. The system of claim 22 wherein one of said data packets comprises at least one data field having a dynamic data structure, said data field including data and an indication indicative of a quantity of said data.

24. The system of claim 19 wherein said data center further comprises an encryption element for encrypting said time limit.

25. The system of claim 24 wherein said time limit is encrypted in accordance with a data encryption standard (DES) cryptographic algorithm.

26. The system of claim 25 wherein said time limit is encrypted using a cipher block chaining (CBC) mode of the DES algorithm.

27. A communications system comprising:

at least one postage meter for processing mail items with varying amounts of postage; and a communications element for directly communicating to said at least one postage meter at least one signal representative of a piece limit restricting the number of mail items to be processed thereby, said meter further comprising a mechanism responsive to said limit for stopping processing of said mail items when said limit is reached.

28. The system of claim 27 wherein said postage meter comprises a display for displaying messages, said communications element of said system further directly communicating to said postage meter messages for display by said displaying means.

29. The system of claim 27 further comprising a processing element for generating data packets for communications with said postage meter.

30. The system of claim 29 wherein one of said data packets comprises at least one data field having a dynamic data structure, said data field including data and an indication indicative of a quantity of said data.

31. The system of claim 27 wherein said data center further comprises an encryption element for encrypting said limit.

32. The system of claim 31 wherein said limit is encrypted in accordance with a DES cryptographic algorithm.

33. The system of claim 32 wherein said limit is encrypted using a CBC mode of the DES algorithm.

34. A communications system comprising:

at least one postage meter for dispensing postage comprising a register for storing an available postage amount for dispensation; and a communications interface for directly transmitting to an external data center at least one signal representative of a request for a postage amount to be added to said available postage amount, the requested postage amount being less than zero; and a data center comprising a communications interface for directly receiving from said at least one postage meter said at least one signal representative of the requested postage amount; and a processor responsive to the received requested postage amount for refunding to a user of said postage meter an absolute value of the requested postage amount.

35. The system of claim 34 wherein said communications element of said data center directly transmits at least one signal to said postage meter causing the postage meter to be disabled so as to prevent further use of said meter.

36. A communication system comprising:

at least one postage meter comprising an electro-mechanical element for dispensing postage;

a memory buffer for providing a pre-selected value as a maximum postage limit up to which cumulative postage dispensed by the meter reaches; and a communications interface for directly transmitting at least one signal representative of a request for an additional postage amount for dispensation after non-zero postage has been dispensed; and a data center comprising a communications interface for directly receiving from said at least one postage meter said at least one signal representative of the requested additional postage amount said communications interface responsive to the requested additional postage amount for directly communicating to said postage meter at least one signal representative of a second value higher than said pre-selected value for causing said maximum postage limit to increase from said pre-selected value to said second value.

37. The system of claim 36 wherein said second value is higher than said pre-selected value by the requested additional postage amount.

38. The system of claim 36 wherein said postage meter comprises a display for displaying messages, said communications element of said system further directly communicating to said postage meter messages for display by said displaying means.

39. The system of claim 36 wherein said processing element further generates additional data packets for communications with said postage meter.

40. The system of claim 39 wherein one of said data packets comprises at least one data field having a dynamic data structure, said data field including data and an indication indicative of a quantity of said data.

41. The system of claim 36 wherein said postage meter further comprises an encryption element for encrypting said requested additional amount.

42. The system of claim 41 wherein said requested additional amount is encrypted in accordance with a DES cryptographic algorithm.

43. The system of claim 42 wherein said requested additional amount is encrypted using a CBC mode of the DES algorithm.

44. The system of claim 36 wherein said data center further comprises an encryption element for encrypting said limit.

45. The system of claim 44 wherein said limit is encrypted in accordance with a DES cryptographic algorithm.

46. The system of claim 45 wherein said limit is encrypted using a CBC mode of the DES algorithm.

47. A method for use in a postage meter device for printing postage of various values comprising the steps of:

processing mail items;

selecting values of postage for said mail items;

defining at least one charge class with a first postage value being an upper bound and a second postage value being a lower bound;

associating a subset of said mail items with said at least one charge class based on postage values selected for said subset;

counting the number of processed mail items associated with said subset; and storing statistical data reflecting the amount of said mail items processed by said postage meter which are associated with said at least one charge class; and directly electronically transmitting at least one signal representative of said statistical data to an external data center.

48. The method of claim 47 wherein said at least one charge class is associated with a predetermined mail class type.

49. The method of claim 47 wherein said first postage value is equal to said second postage value.

50. The method of claim 47 wherein said subset of said mail items each have a selected postage value not higher than said first postage value and not lower than said second postage value.

51. The method of claim 47 further comprising the step of transmitting a signal representative of said number of items at a pre-selected time.

52. The method of claim 51 further comprising the step of storing said pre-selected time.

53. A method for use in a postage meter device for printing postage comprising the steps of:

processing mail items including the application of postage of varying amounts;

receiving at least one signal from an external data center, said signal representative of a piece limit restricting a number of mail items to be processed; and stopping, in response to the received limit, the processing of said mail items when said limit is reached.

54. A method for use in a postage meter device for printing postage comprising the steps of:

dispensing postage;

providing a pre-selected value as a maximum postage limit up to which cumulative postage dispensed by the meter reaches;

directly receiving from an external data center at least one signal representative of a second value higher than said pre-selected value after non-zero postage has been dispensed; and increasing said maximum postage limit from said pre-selected value to said second value.

55. A method for use in a communications system including a data center in direct communication with a plurality of postage meters for printing postage, said method comprising the steps of:

directly communicating to a selected one of said postage meters at least one signal representative of at least a first postage value and a second postage value for defining at least one class in the selected meter;

storing said first and second postage values;

processing by the selected postage meter mail items;

selecting postage for said mail items;

associating a subset of said mail items with said at least one class based on postage values selected for said subset;

counting the number of mail items associated with said subset; and storing statistical data reflecting the amount of said mail items processed by said postage meter which are associated with said at least one charge class.

56. The method of claim 55 wherein said at least one charge class is associated with a predetermined mail class type.

57. The method of claim 55 wherein said first postage value is equal to said second postage value.

58. The method of claim 55 wherein said subset of said mail items each have a selected postage not higher than said first postage value and not lower than said second postage value.

59. The method of claim 55 further comprising the step of generating data packets for communications with said postage meter.

60. The method of claim 59 wherein one of said data packets comprises at least one data field having a dynamic data structure, said data field including data and an indication indicative of a quantity of said data.

61. The method of claim 55 wherein said method further comprises the step of transmitting by the selected meter a signal representative of said number of items at a pre-selected time.

62. The method of claim 61 further comprising the step of receiving said signal.

63. The method of claim 61 wherein said method further comprises the step of storing said pre-selected time in the selected meter.

64. A method for use in a communications system including at least one postage meter for processing mail items, said method comprising the steps of:

directly communicating to said postage meter by an external data center at least one signal representative of a time limit restricting a time period during which said mail items are processed by said meter;

stopping, in response to said limit, processing of said mail items by said postage meter when said time limit is reached;

determining whether the time limit previously communicated to said meter has been reached; and when the previous time limit is determined to have been reached, directly communicating a new time limit to said meter to resume processing of said mail items upon a satisfaction of one or more predetermined conditions.

65. The method of claim 64 wherein said time limit is defined by a pre-selected date.

66. The method of claim 64 further comprising the step of generating data packets for communications with said postage meter.

67. The method of claim 66 wherein one of said data packets comprises at least one data field having a dynamic data structure, said data field including data and an indication indicative of a quantity of said data.

68. The method of claim 64 further comprising the step of encrypting said time limit.

69. The method of claim 68 wherein said time limit is encrypted in accordance with a DES cryptographic algorithm.

70. The method of claim 69 wherein said time limit is encrypted using a CBC mode of the DES algorithm.

71. A method for use in a communications system including at least one postage meter for processing mail items with varying postage, said method comprising the steps of:

directly electronically communicating to said at least one postage meter at least one signal representative of a piece limit restricting a number of mail items to be processed thereby; and stopping, in response to said piece limit, processing of said mail items when said piece limit is reached.

72. The method of claim 71 further comprising the step of generating data packets for communications with said postage meter.

73. The method of claim 72 wherein one of said data packets comprises at least one data field having a dynamic data structure, said data field including data and an indication indicative of a quantity of said data.

74. The method of claim 71 further comprising the step of encrypting said limit.

75. The method of claim 74 wherein said limit is encrypted in accordance with a DES cryptographic algorithm.

76. The method of claim 75 wherein said limit is encrypted using a CBC mode of the DES algorithm.

77. A method for use in a communications system including at least one postage meter for dispensing postage, said method comprising the steps of:

storing by said at least one postage meter an available postage amount for dispensation;

requesting a postage amount to be added to said available postage amount, the requested postage amount being smaller than zero; and receiving from said at least one postage meter the requested postage amount; and refunding, in response to the received requested postage amount, to a user of said postage meter an absolute value of the requested postage amount.

78. The method of claim 77 further comprising the step of causing said postage meter to be disabled so as to prevent further use of said meter.

79. A method for use in a communications system including at least one postage meter, said method comprising the steps of:

dispensing postage by said postage meter;

providing a pre-selected value as a maximum postage limit up to which cumulative postage dispensed by said postage meter reaches;

directly communicating to an external data center by said postage meter at least one signal representative of a request for an additional postage amount for dispensation after non-zero postage has been dispensed;

directly receiving by said data center from said postage meter the requested additional postage amount; and directly communicating to said postage meter by said data center, in response to the requested additional postage amount, at least one signal representative of a second value higher than said pre-selected value for causing said maximum postage limit to increase from said pre-selected value to said second value.

80. The method of claim 79 wherein said second value is higher than said pre-selected value by the requested additional postage amount.

81. The method of claim 79 further comprising the step of generating data packets for communications with said postage meter.

82. The method of claim 81 wherein one of said data packets comprises at least one data field having a dynamic data structure, said data field including data and an indication indicative of a quantity of said data.

83. The method of claim 79 further comprising the step of encrypting said requested additional amount.

84. The method of claim 83 wherein said requested additional amount is encrypted in accordance with a DES cryptographic algorithm.

85. The method of claim 84 wherein said requested additional amount is encrypted using a CBC mode of the DES algorithm.

86. The method of claim 79 further comprising the step of encrypting said limit.

87. The method of claim 86 wherein said limit is encrypted in accordance with a DES cryptographic algorithm.

88. The method of claim 87 wherein said limit is encrypted using a CBC mode of the DES algorithm.

* * * * *

UNITED STATES PATENT AND TRADEMARK OFFICE

CERTIFICATE OF CORRECTION

PATENT NO. : 5,715,164
DATED : February 3, 1998
INVENTOR(S) : Liechti et al.

It is certified that error appears in the above-identified patent and that said Letters Patent is hereby corrected as shown below:

Column 8, line 31, "D." should read - - $D_n$ - - ;

Column 8, line 34, "$D_O$" should read - - $D_n$ - - ;

Column 13, line 45, "1015" should read - - 1015 includes - - ;

Column 15, line 12, "field" should read - - field 1200 is - - ;

Column 15, following line 15, insert as the next line - - bytes - - ;

Column 17, line 4, "holds" should read - - hold - - ;

Column 18, line 32, "physically" should read - - physical - - ;

Column 20, line 36, "postage" should read - - postage value - - .

Signed and Sealed this

Fifteenth Day of September, 1998

*Attest:*

*Attesting Officer*

Bruce Lehman

BRUCE LEHMAN

*Commissioner of Patents and Trademarks*